US009943726B2

(12) United States Patent
Tilson et al.

(10) Patent No.: US 9,943,726 B2
(45) Date of Patent: Apr. 17, 2018

(54) AQUATIC SWIM TRAINING DEVICES

(71) Applicant: Aquatic Research and Training Technology LLC, Meansville, GA (US)

(72) Inventors: Bethany Christine Tilson, Meansville, GA (US); Eric Jeffery Snell, Meansville, GA (US); Warren Nicholas Snell, Meansville, GA (US); Jackson Lee Snell, Meansville, GA (US)

(73) Assignee: Aquatic Research and Training Technology, LLC, Meansville, GA (US)

( * ) Notice: Subject to any disclaimer, the term of this patent is extended or adjusted under 35 U.S.C. 154(b) by 0 days.

(21) Appl. No.: 14/850,743

(22) Filed: Sep. 10, 2015

(65) Prior Publication Data

US 2016/0067551 A1 Mar. 10, 2016

Related U.S. Application Data

(60) Provisional application No. 62/048,444, filed on Sep. 10, 2014, provisional application No. 62/142,042, filed on Apr. 2, 2015.

(51) Int. Cl.
*A63B 31/10* (2006.01)
*A63B 31/04* (2006.01)

(52) U.S. Cl.
CPC ..... *A63B 31/04* (2013.01); *A63B 31/10* (2013.01); *A63B 2210/50* (2013.01); *A63B 2225/09* (2013.01)

(58) Field of Classification Search
CPC . A63B 69/12; A63B 21/0084; A63B 2208/03; A63B 31/00; A63B 2225/60; A63B 21/00065; A63B 21/0004; A63B 23/03508; A63B 21/4025; A63B 21/4043; A63B 2244/20; A63B 69/0059; A63B 21/4013; A63B 21/4035; A63B 2208/12; A63B 2210/50; A63B 21/4015; A63B 2225/605; A63B 23/12; A63B 24/0062; A63B 69/14; A63B 21/0552; A63B 35/00; A63B 2071/0694; A63B 21/00061; A63B 21/00069; A63B 21/0606; A63B 2225/09; A63B 21/0442; A63B 31/10; A63B 31/12; A63B 21/0557; A63B 31/04; A63B 31/08; A63B 31/11; A63B 2209/10; A63B 35/06;

(Continued)

(56) References Cited

U.S. PATENT DOCUMENTS 91,300 A * 6/1869 Barnett ..... A63B 31/08
441/58
950,633 A * 3/1910 Eastman ..... A63B 31/10
2/20

(Continued)

*Primary Examiner* — Andrew S Lo
(74) *Attorney, Agent, or Firm* — Kim Winston LLP

(57) ABSTRACT

An aquatic training device including a body having a contact surface for engaging a hand of a user and a securing fin extending substantially transverse from the contact surface. The securing fin further includes a retaining member spaced from the contact surface. The aquatic training device is designed to improve a user's stroke technique, particularly with respect to hand arm positioning while swimming, by forcing the user to engage shoulders, arms, elbows, wrists, hands, and fingers in optimal hand arm positions while swimming.

22 Claims, 21 Drawing Sheets

(58) Field of Classification Search
CPC ..... A63B 21/065; A63B 21/4019; A63B 21/4021; A63B 35/02; A63B 2031/117; A63B 2071/0663; A63B 21/0602; A63B 21/4011; A63B 21/4017; A63B 23/16; A63B 69/00; A63B 71/141
USPC ..... 482/55; 441/56, 58
See application file for complete search history.

(56) References Cited

U.S. PATENT DOCUMENTS

| | | | | | |
|---|---|---|---|---|---|
| 1,004,394 | A | * | 9/1911 | Enders | A63B 31/08 441/58 |
| 1,062,587 | A | * | 5/1913 | Goersch | A63B 31/08 2/20 |
| 1,140,107 | A | * | 5/1915 | Brown | A63B 31/08 2/16 |
| 1,490,643 | A | * | 4/1924 | Snapp | A63B 31/14 441/58 |
| 1,621,693 | A | | 3/1927 | Theobold | |
| 1,708,331 | A | * | 4/1929 | Ryan | A63B 31/08 441/58 |
| 1,754,704 | A | * | 4/1930 | Wilcox | A63B 31/08 441/58 |
| 2,313,979 | A | * | 3/1943 | Tuma | A63B 31/08 441/58 |
| 2,745,119 | A | | 5/1956 | Whipple | |
| 2,850,748 | A | | 9/1958 | Read | |
| 3,258,794 | A | * | 7/1966 | Goodwin | A63B 31/08 441/56 |
| 3,765,042 | A | | 10/1973 | Montrella | |
| D262,477 | S | * | 12/1981 | Lewis | 441/59 |
| 4,316,300 | A | * | 2/1982 | Lewis | A63B 31/08 441/59 |
| 4,509,744 | A | * | 4/1985 | Beasley | A63B 31/08 441/58 |
| 4,521,011 | A | | 6/1985 | Solloway | |
| 5,147,233 | A | | 9/1992 | Hannula | |
| 5,288,254 | A | * | 2/1994 | Elson | A63B 31/10 441/56 |
| 5,304,080 | A | * | 4/1994 | Dilger | A63B 31/08 416/72 |
| 5,376,036 | A | | 12/1994 | Hull | |
| D363,754 | S | * | 10/1995 | Johnson | D21/807 |
| 5,511,998 | A | | 4/1996 | Johnson | |
| 5,643,027 | A | | 7/1997 | Evans | |
| 5,658,224 | A | * | 8/1997 | Betrock | A63B 31/10 441/58 |
| 5,842,896 | A | * | 12/1998 | Liveoak | B63H 16/04 440/101 |
| 6,019,650 | A | * | 2/2000 | Rives | A63B 31/10 441/56 |
| 6,743,023 | B2 | | 6/2004 | Topolski | |
| 7,033,235 | B1 | * | 4/2006 | Slimi | A63B 31/10 441/56 |
| 7,125,299 | B1 | * | 10/2006 | Ross, Jr. | A63B 31/04 441/56 |
| 7,147,526 | B1 | | 12/2006 | Chiang | |
| 7,179,146 | B2 | | 2/2007 | Johnson | |
| 7,267,595 | B1 | | 9/2007 | Hall | |
| 7,361,070 | B2 | | 4/2008 | Bolstor | |
| 7,566,252 | B2 | | 7/2009 | Bolster | |
| 8,496,506 | B2 | | 7/2013 | Wenzel | |
| 8,585,453 | B2 | | 11/2013 | Doyle | |
| 8,790,224 | B1 | * | 7/2014 | Davis | A63B 21/0084 441/50 |
| 9,364,717 | B2 | * | 6/2016 | Davis | A63B 31/11 |
| 2002/0098952 | A1 | * | 7/2002 | Stout | A63B 21/0084 482/55 |
| 2008/0200083 | A1 | * | 8/2008 | Balleto | A63B 31/12 441/58 |
| 2011/0165804 | A1 | * | 7/2011 | Wenzel | A63B 31/10 441/58 |
| 2012/0009833 | A1 | * | 1/2012 | Doyle | A63B 31/10 441/56 |
| 2014/0187110 | A1 | * | 7/2014 | Faidi | A63B 31/12 441/56 |

* cited by examiner

AQUATIC SWIM TRAINING DEVICES

CROSS REFERENCE TO RELATED APPLICATIONS

The present application claims the benefit of U.S. Provisional Patent Application No. 62/048,444 filed Sep. 10, 2014 entitled "Swim Training Paddles" and U.S. Provisional Patent Application No. 62/142,042 filed Apr. 2, 2015 entitled "Swim Training Paddles II," the entire disclosures of which are incorporated by reference herein.

BACKGROUND OF THE INVENTION

The present invention relates to aquatic swim training devices or training aids in swimming or swim training to improve muscular condition and/or enhance user stroke technique by forcing the user to engage shoulders, arms, elbows, wrists, hands, and fingers in the optimal hand and arm position during strokes to maximize efficiency in swimming.

Modern training aids for use in swim training are often employed to increase muscular condition and/or technique in users. The basic function of many hand paddles is to increase the effective surface area of the hands to increase resistive force capable by the hand and paddle, which increases the speed of swimming and provides more rigorous exercise for various muscles. Previously patented training aids disclosed in U.S. Pat. No. 1,621,693, U.S. Pat. No. 3,765,042, U.S. Pat. No. 5,147,233, U.S. Pat. No. 5,376,036, U.S. Pat. No. 7,147,526, U.S. Pat. No. 7,179,146, and U.S. Pat. No. 8,496,506 relate to paddles that provide resistance for increased speed and muscle training, but they have a limited ability to improve stroke technique and hand position.

Other paddles, such as disclosed in U.S. Pat. No. 5,511,998, focus on the size and shape of the paddle as a means of creating a torque on the paddle. However, the paddle itself has no means of forcing the user into the proper hand position or even any means of informing the user where this position is, forcing the user to determine the proper hand position with limited reinforcements.

Modern swimming techniques and training methods attempt to improve efficiency in swimming strokes and focus on a maximum amount of propulsive force for each stroke. This efficiency depends on the positioning of a swimmer's hands and forearms perpendicular to their movement, maximizing the normal force. Training aids, including hand paddles, are often employed, and it is an objective of the present invention to reinforce the desired optimal hand positions by monitoring and/or preventing improper positions.

BRIEF SUMMARY OF THE INVENTION

In accordance with a preferred embodiment, the present invention provides an aquatic training device that includes a body having a contact surface for engaging a hand of a user and a securing fin extending substantially transverse from the contact surface. The securing fin includes a retaining member spaced from the contact surface. The aquatic training device further includes a resistive member adjacent to and extending along a lateral side of the contact surface and a tether attachable to the resistive member for securing the aquatic training device to a user's hand or forearm. The securing fin has a substantially T-shaped longitudinal cross-section. The retaining member extends from the securing fin at an angle about a dorsal end of the securing fin. The securing fin may be a substantially planar wall and the retaining member includes flaps extending laterally from the planar wall.

The aquatic training device further includes a pair of lateral retaining members extending from opposite lateral ends of the contact surface and an elongated extension extending from a posterior end of the body for supporting a forearm of the user. The lateral retaining members have a generally curvilinear longitudinal cross-sectional profile and may include a coupling member for connecting the lateral retaining members together. The elongated extension is slidably attached to the body and further includes a concave shaped base about a posterior end. The elongated extension further includes a baffle slidably attached to the elongated extension. The baffle is slidably attached to a track on the elongated extension and is substantially U-shaped or substantially hemispherical shaped. Furthermore, the elongated extension includes a securing element for securing the elongated extension to a user. The securing element may be a tether, a rope, or a strapping material.

In accordance with another preferred embodiment, the present invention provides an aquatic training device that includes a hollow body and a dorsal fin-like member. The hollow body includes a top surface, a closed anterior end, and an open posterior end. The dorsal fin-like member extends from the top surface for engaging between fingers of a user's hand. The dorsal fin-like member further includes a retaining flap extending from a dorsal end of the dorsal fin-like member. An anterior end of the top surface has a parabolic shape. The hollow body has a curved bottom surface and further includes at least one inwardly extending fin.

In accordance with yet another preferred embodiment, the present invention provides an aquatic training device that includes a body having a top surface and bottom surface. The aquatic training device further includes a dorsal fin-like member extending from the top surface for engaging between fingers of a user's hand and a retaining flap extending from a dorsal end of the dorsal fin-like member.

The present invention includes means for securing paddles to the hand while still allowing movement between the paddle and the hand. Additional disclosures of the present invention illustrate means of utilizing the movement between the paddle and the hand as a means to train users when they are performing improper stroke technique(s) wherein the paddle can catch water inside the paddle when moving the hand parallel to the desired movement plane at the early phase of the stroke. Additionally, the present invention can provide similar feedback when the swimmer pulls up with their elbow too soon during the final outsweep phase of a crawl stroke or butterfly stroke.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
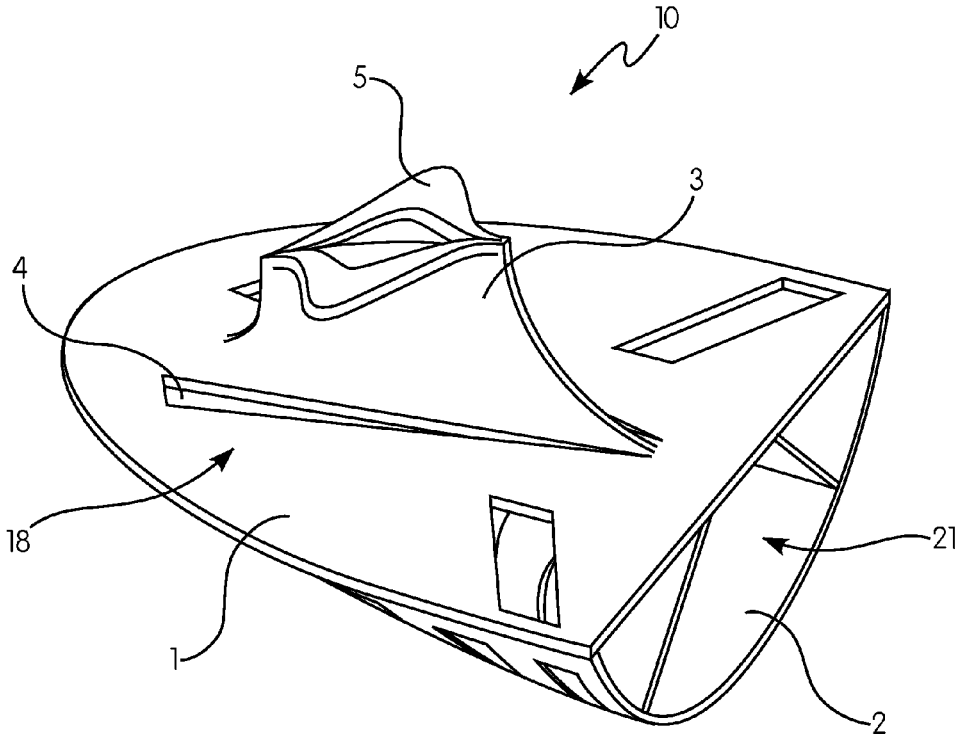
FIG. 1 is a perspective view of an aquatic training device in accordance with a preferred embodiment of the present invention.

Reference will now be made in detail to the preferred embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. The term "proximal" shall mean towards the center of an object. The term "distal" shall mean away from the center of an object. Such directional terms used in conjunction with the following description of the drawings should not be construed to limit the scope of the invention in any manner not explicitly set forth.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the identified element and designated parts thereof. Additionally, the term "a," as used in the specification, means "at least one." The terminology includes the words noted above, derivatives thereof and words of similar import.

As used herein, "resistive means" or "resistive member" refers to mechanisms for providing resistive force for a particular motion. The 'resistive means' or 'resistive member' can pertain to mechanisms for providing proper and desired stroke mechanics for propelling the body forward through the water. Likewise, 'resistive means' can also refer to incorrect forces that are applied to a paddle or a body component due to incorrect stroke technique. "Contact surface" refers to portions of a hand paddle that contact and support the hand, forearm, and/or fingers. The contact surface may be flat or formed to the shape of the hand and/or fingers, and may be solid and/or porous to allow movement of water.

As used herein, "reduced function" with respect to securing member/element refers to a reduction of the force necessary to overcome the secured member/element and allow motion of the hand away from the securing member/element.

As used herein, "proper stroke technique" refers to placement and motion of individual components of the swimmer's body that maximize the efficiency of strokes for movement in the desired direction. As used herein, "swim training" refers to the use of training methods and/or training aids in order to improve a swimmer's muscular and cardiovascular condition and/or a swimmer's ability to employ proper stroke technique while swimming.

As used herein, "optimal hand and arm position" refers to the placement of the hand and arm in the water with relation to the motion of the arm and hand through the water in such a way as to maximize the resistive force capable of the hand and arm for forward movement of the swimmer. To maximize the resistive force, the planes of the hand and arm are optimally perpendicular to the desired movement through the water to maximize normal force of the arm and hand; the optimal hand and arm position for a complete stroke is therefore as close to the above described orientation as possible. As used herein, "improper hand and arm position" refers to components of motion of the hand and arm that are unnecessarily parallel to the desired movement through the water. The positions reduce the forces of the arm and hand that can cause movement in a desired direction. "Early Vertical Catch" or "Early Vertical Forearm" refers to the relative positions of the hand, forearm, and elbow during the initiation of a swim stroke (the 'catch') that increases resistive force by raising the elbow while dropping the hand and forearm to achieve optimal hand and arm position.

In accordance with preferred embodiments, the present invention provides an aquatic training device 10, as shown in FIGS. 1-4, 6-9, 14-20, 25 and 26. The aquatic training device 10 is designed to enable more efficient stroke techniques through a range of paddle designs pertaining to use in aquatic exercise or swim training to improve a user's stroke technique, particularly with respect to hand and arm position while swimming. If used improperly in a user's stroke, the design of the aquatic training device 10 can allow various paddles to mechanically alert the user that the stroke is incorrect. The mechanism(s) for indicating improper stroke technique include movement of the paddle in relation to the user's hand and/or change(s) in the stimuli of the water on the user's hand. The mechanisms provide tangible stimuli to aid users in monitoring and improving stroke technique. The included figures show preferred embodiments with respect to aquatic exercise and swim training.

Figure 2:
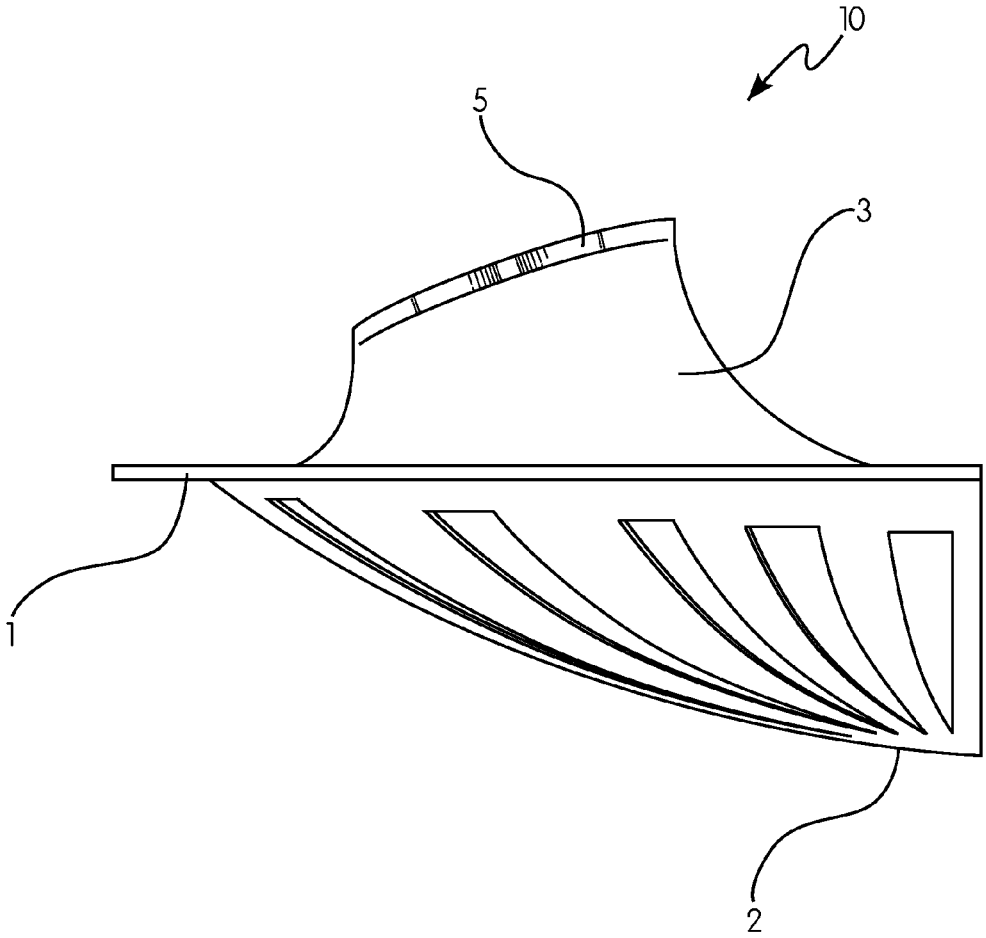
FIG. 2 is a side view of the aquatic training device of FIG. 1.
Figure 3:
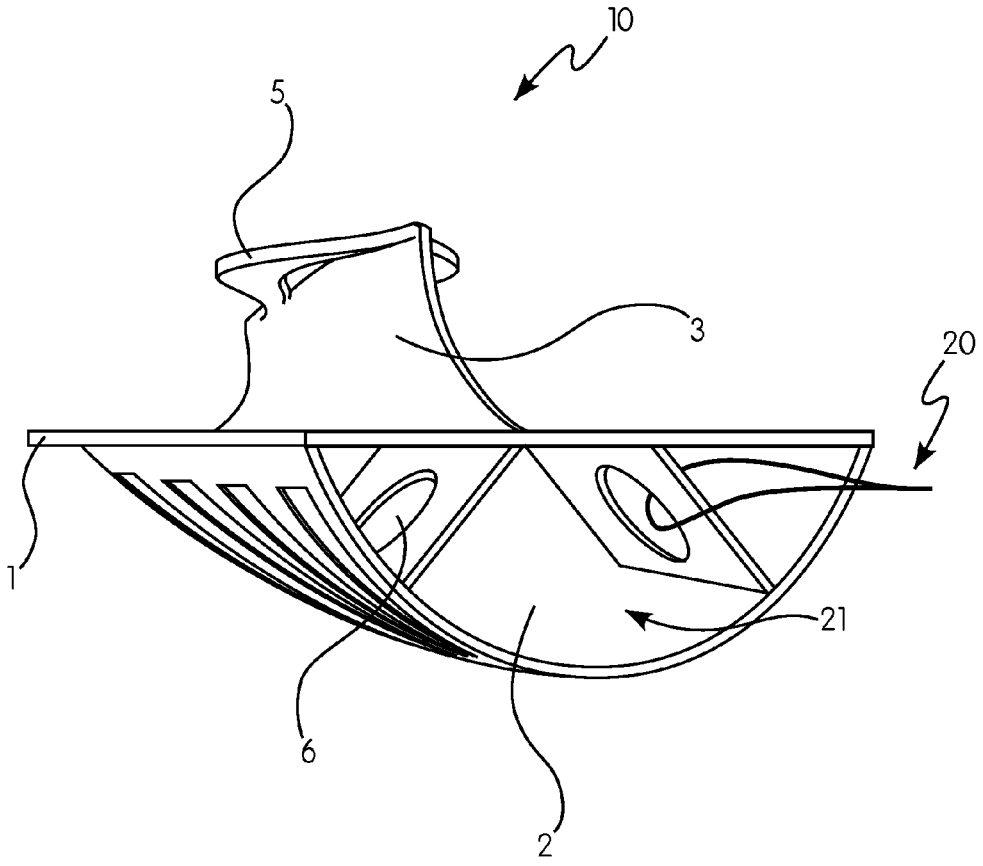
FIG. 3 is a rear perspective view of the aquatic training device of FIG. 1.

FIGS. 1-3 depict a first preferred embodiment of the present invention and several of its components. The aquatic training device 10 includes a body having a contact surface 1 for engaging a hand of a user. A resistive member 2 is positioned adjacent to and extends along a lateral side of the contact surface 1. The aquatic training device further includes a securing member 3, e.g., a securing fin or gripping fin, extending substantially transverse from the contact surface 1. The securing member 3 includes a retaining member 5 spaced from the contact surface 1.

In these figures of various angles of one possible design, the contact surface 1 is positioned and connected to the resistive member 2. The contact surface 1 may be configured to be flat or formed to the shape of a user's hand or fingers. For example, the contact surface 1 may be solid and/or porous to allow water to pass from one side to the other. Additionally, the contact surface can have textured or raised surfaces. The contact surface 1 will contact the user's hand and/or fingers such that a cavity 21 of the resistive member 2 diminishes along the user's fingers and closes at the user's fingertips, leaving the open face of the resistive member 2 facing away from the user's fingertips and towards the user's hand/forearm.

As shown in FIGS. 1-3, the resistive member 2 is configured as a partially enclosed hollow body forming cavity 21, having a closed anterior end and an open posterior end. The resistive member 2 is configured and adapted to capture or deflect water, such as pool water or salt water. An additional mechanism of the resistive member 2 creates tactile stimuli during improper hand and arm positions without requiring motion of the paddle relative to the user's hand. The contact surface 1 may be porous and/or open to allow water to pass from one side to the other. The resistive member 2 forces water towards the contact surface 1 for motion that has components parallel to the contact surface 1. Specifically, the water reaches the user's hand and/or fingers through the contact surface 1. The stimulus created by water movement indicates improper positions to the user without any interruption of strokes or relative motion of the paddle, allowing constant monitoring of stroke technique. The curved shape of the resistive member 2 also serves to displace water around the hand and finger area to reduce the perpendicular resistance on the contact surface 1 and helps the user to better focus on creating forward power with the wrist and forearm. FIG. 3 further shows possible attachment openings 6 on the resistive member 2 for an elastic or inelastic tether to prevent the paddle from moving more than a certain distance away from the user's hand.

As shown in FIGS. 1-3, the securing member 3 is configured as a securing fin 3 or gripping fin 3 which can be positioned between the user's fingers. Specifically, the gripping fin is configured as a substantially planar wall extending from the contact surface. The gripping fin 3 can be positioned substantially parallel and adjacent to the user's fingers or hand and between and/or beside the user's fingers to provide frictional forces. Further, the gripping fin 3 includes a retaining member 5 that prevents the user's hand from losing contact with the paddle, which preferably extends in a direction substantially perpendicular to the contact surface 1 while allowing motion in a direction parallel to the contact surface 1. The retaining member 5 extends from the gripping fin about a dorsal end of the gripping fin. The retaining member 5 may be curved over the fingers or hand to further secure the paddle to the user while allowing motion of the paddle.

Figure 14:
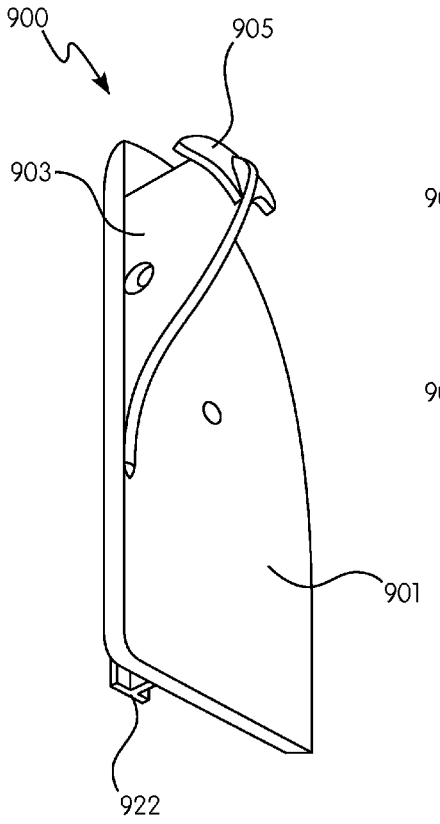
FIG. 14 is a perspective view of an aquatic training device in accordance with another preferred embodiment of the present invention.
Figure 15:
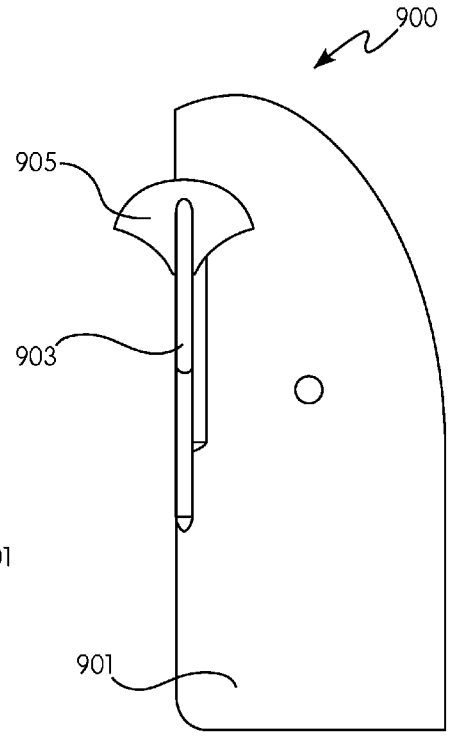
FIG. 15 is a top plan view of the aquatic training device of FIG. 14.

The gripping fin 3 and the retaining member 5 form a substantially T-shaped gripping mechanism that prevents the user's hands from losing contact with the paddle. Additionally, the gripping fin extends out from an anterior portion of the contact surface so as to align between the fingers of a user. Specifically, the gripping fin is positioned so as to extend parallel to the user's fingers and between the fingers. The gripping fin 3 allows movement between the hand and contact surface 1 when resistive forces are at least partially parallel to the contact surface. Preferably, the gripping fin 3 extends from the contact surface 1 at a position equidistant from respective lateral ends of the contact surface 1. Additionally, the gripping fin 3 can be positioned along a midline of the contact surface 1 (FIG. 1) or a lateral side of the contact surface 1 (FIGS. 14 and 15).

Possible directional securing means in FIGS. 1-3 include the resistive function of the contact surface 1 and the securing member 3 which is shown configured as a securing fin 3 or gripping fin 3 which can be positioned between the user's fingers. The contact surface 1 provides a resistive friction force when the user's hand and/or fingers are applying pressure on the contact surface, allowing motion of the hand if this resistive friction is overcome. The gripping fin 3 also provides a directional friction force that can be overcome if a greater amount of force is applied. The cavity 21 of the resistive member 2 provides additional force from drag in the water if its motion has components that are parallel to the contact surface 1. The additional force from an improper hand position overcomes the resistive forces of the gripping fin 3, allowing motion of the invention in relation to the user's hand/fingers. Openings 4 in the contact surface 1 function to allow water to leave the cavity 21 of the resistive member 2 and come in contact with the user's hand and/or fingers. This movement of water increases as the motion of the paddle is more parallel to the contact surface 1, providing stimulus for the swimmer indicating improper stroke position. A remaining mechanism for providing the user with feedback for improper stroke technique includes a raised or textured surface 18 on the contact surface 1 that interfaces with the user's hand. Any movement between the hand and contact surface 1 is more readily felt by the user when the contact surface 1 has textured or raised surfaces. This can provide a more sensitive response for the user than any other mechanism.

Figure 4:
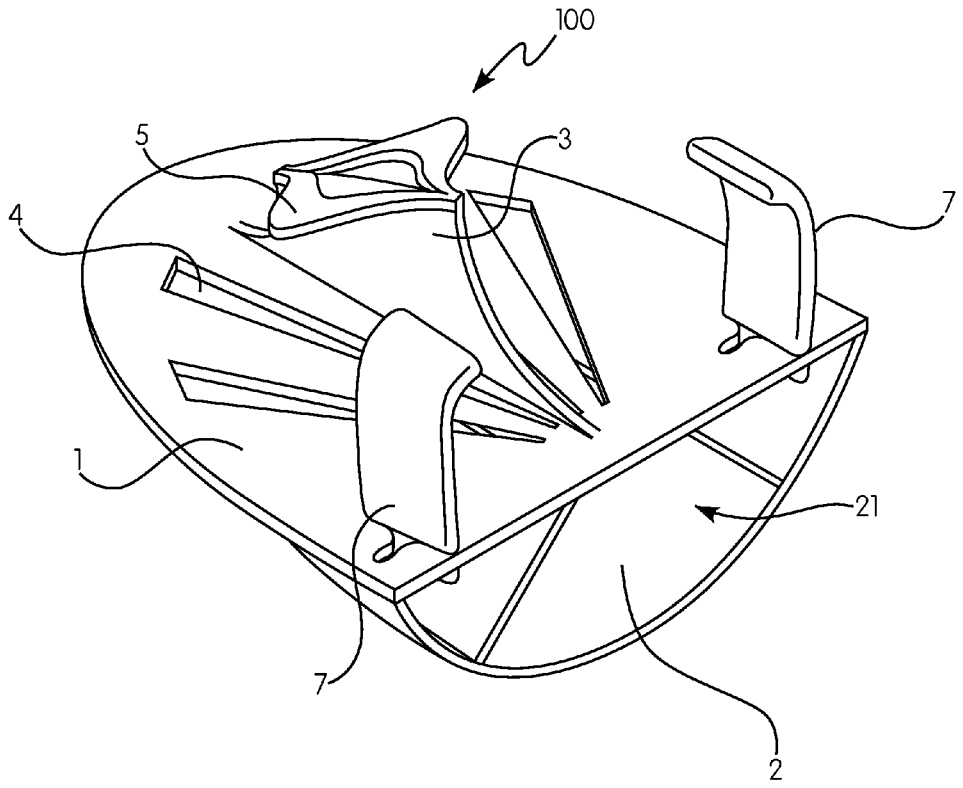
FIG. 4 is a rear perspective view of the aquatic training device of FIG. 1 in accordance with another aspect of the present embodiment.

FIG. 4 shows a second preferred embodiment of the aquatic training device 100 that is similar to aquatic training device 10 but includes a pair of lateral retaining members 7 to further affix the user's hand and/or fingers to the paddle and prevent motion of the paddle in relation to the hand that is not caused by motion that has components parallel to the contact surface 1. The lateral retaining members 7 are angled from the middle axis of the paddle to the edges, providing added resistance for motion along the middle axis which can still be overcome to allow movement between the contact surface 1 and the hand. The lateral retaining members 7 are configured as substantially planar walls extending from opposite lateral ends of the contact surface. The lateral retaining members 7 are configured to have a generally curvilinear profile. Specifically, the lateral retaining members 7 may be curved over the fingers or hand to further secure the paddle to the user while allowing motion of the paddle. For example, the lateral retaining members 7 may also be angled or perpendicular to the fingers and/or hand of the user.

Figure 5:
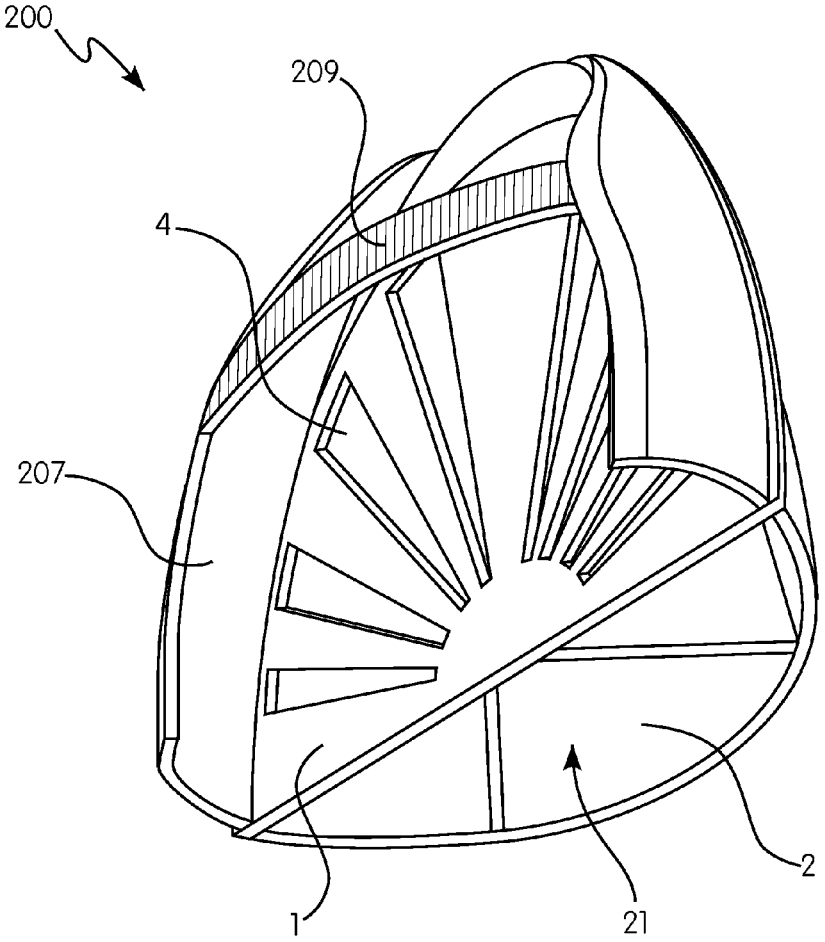
FIG. 5 is a rear perspective view of an aquatic training device in accordance with another embodiment of the present invention.

FIG. 5 shows a third preferred embodiment of an aquatic training device 200 in accordance with the present invention having lateral retaining members 207 as an additional securing member. These lateral retaining members 207 have a curved path that curves outward from the user's knuckles and back inward around the user's fingertips. The curvature of the lateral retaining members 207 further secures the paddle to the user while still allowing movement between the contact surface 1 and the hand. A coupling member 209 goes over the user's fingers to prevent the paddle from losing contact with the user in a direction perpendicular to the contact surface 1. The coupling member has a first end and a second end opposite the first end connecting the respective lateral retaining members 207. The coupling member 209 further secures the fingers or hand of a user to the paddle while allowing motion of the paddle.

As shown in FIG. 3, tethers, elastic and/or inelastic 20, can also be used to secure the paddle to the user without restricting the movement of the paddle caused by incorrect stroke techniques. For example, an elastic tether attached to the user and with a length longer than the paddle could allow the paddle to lose contact with the user yet keep the paddle within reach of the user if the stroke technique causes it to come off the hand. The tethers or elastic straps can attach individual fingers or the wrist to the paddle with enough excess strap to allow for movement of the paddle on the hand when a stroke technique is incorrect. This movement provides feedback to the user while preventing the paddle from coming completely off the hand or while keeping the paddle attached loosely to the body for a quick recovery of the paddle back to the hand surface in the event that the paddle comes completely off the hand.

In order to provide positive or negative feedback to the user, it is important that paddle designs in accordance with the present invention include securing members and securing elements which can allow for movement of the paddle on the interface of the hand and upper surface of the paddle. Conventional paddle securing elements such as tubing, elastic straps, and hook and latch straps secure the hand too tightly to the paddle surface to allow any clear feedback from the movement of the paddle itself on the hand surface. Openings 4 can be added to conventional paddle designs which allow forced water to contact the surface of the hand, but this provides no technique feedback as the forced water is constant, regardless how the paddles are used. Therefore while the various embodiments of the disclosed invention can incorporate a range of securing members and securing elements for securing the paddle to the hand, the ideal securing members and securing elements involve adequate freedom of movement of the paddle when used incorrectly.

Preferably, as discussed above, securing members for the disclosed embodiments incorporate upright wall(s), e.g., the gripping fin 3 and lateral retaining members 7, to contact the user's finger(s) or side of the hand to provide a frictional force that can secure the hand to the paddle. Any number of the upright walls could be positioned parallel to the user's fingers or hand and between and/or beside the user's fingers to provide frictional forces. The frictional forces can be overcome if force from the resistive member 2 is larger, allowing motion of the paddle relative to the hand. The upright walls may be curved over the fingers or hand to further secure the paddle to the user while allowing motion of the paddle. The upright walls may also be angled or perpendicular to the fingers and/or hand. When fingers are in a "relaxed" position for swimming, the gap between the fingers are naturally wider at the fingertips and thinner at the knuckles. Upright walls can be small in length, but if angled outward and located at a narrow location the upright walls can provide substantial force to secure the paddle during proper hand position.

Combinations of the above mentioned securing members and securing elements, e.g. gripping fin 3, lateral retaining members 7, tether 20 and other potential securing members, could create multiple orientations of contact for the user and the paddle. For example, an upright wall parallel to the user's fingers and contacting the user's fingers could create a gripping means and a swimming orientation of the paddle and the user's hand/fingers through frictional forces of the upright wall. Angled upright walls could be located further away from the finger tips and past the constriction point of the knuckles when fingers are in a relaxed position so as to not be actively contacting the user. If the frictional force of the first upright wall is overcome, the hand paddle will shift towards the user's fingertips until the relaxed position of the user's fingers contact the angled upright walls. Movement to this secondary position alerts the user to improper stroke technique without interrupting a swim stroke. The user may then return to the first position for continued monitoring. A tether with a length shorter than the paddle and attached to the user's hand or finger(s) and the paddle may serve a similar function of allowing two positions, a fully engaged hand position and a loosened hand position. During proper hand position, the tether would not apply a force to the user. During improper hand positions, the added resistance from the resistive member 2 will cause the paddle to shift in relation to the hand until the tether matches the force of the resistance. This creates a second position to alert the user to improper technique at the full extension of the tether.

As previously discussed, the strongest stimuli for improving stroke technique involves the complete disconnect of the contact surface 1 of the paddle from the hand if improper positions are employed. This forces proper stroke technique in hand position, as the disclosed invention cannot be used as a paddle with improper stroke technique. The hand may also remain in contact with the contact surface 1 but shift or move along the contact surface without completely losing contact if strokes are improper. This mechanism does not interrupt swimming to indicate improper stroke mechanics and is still functional even with improper technique, allowing continuous monitoring and adjustment of stroke technique. A final mechanism of some embodiments of the present invention is to channel water to the hand if the paddles using the disclosed technology are used with improper technique, providing a stimulus for the user that allows finer adjustments of technique with continuity of the stroke. Any of these mechanisms may be employed by the disclosed invention in any combination to aid in correcting stroke techniques of the user.

In other words, the disclosed embodiments include generally a contact surface 1 that can support the user's hand and/or the user's fingers and a securing member 3 for securing the hand to the paddle's contact surface 1. Additionally, paddle designs using the disclosed technology further include resistive member(s) 2. The resistive member 2 provide(s) additional force components parallel to the contact surface for motion of the hand that is not perpendicular to the contact surface 1 during the early and main power phases of the strokes. Because the improper position for the hand is parallel to the hand's motion, the resistive member 2 creates additional resistance when hand position is improper. The resistive member 2 also provides feedback of improper stroke technique during the outsweep of many strokes such as freestyle/crawl stroke, and butterfly. When the swimmer bends at the elbows and exits their arm from the water with the elbow leading instead of a reasonably straight elbow, a paddle with the resistive member 2 will alert the user of an improper elbow-leading exit. A bent elbow during the outsweep of the crawl and butterfly stroke will cause the hand and paddle to exit the water partially perpendicular to the body position which will cause the resistive member 2 to apply force on the paddle. As with the catch phase of a stroke, the bent and leading elbow during the outsweep will cause an additional force parallel to the contact surface 1.

Additional force parallel to the contact surface 1 caused by the resistive member 2 can be used in conjunction with a directional securing means. A directional securing means can have reduced function in a direction parallel to the contact surface 1; as hand and arm position through motion become increasingly parallel to the movement of the swimmer, the resistive forces created by the resistive member 2 increase in the direction of reduced function for the directional securing means. When the frictional force(s) limit of the directional securing means is met, the contact surface 1 of the hand paddle will move to a new position or lose contact with the user, providing feedback to the swimmer or causing a break in swimming when improper stroke technique is employed to reinforce the optimal positions.

Figure 6:
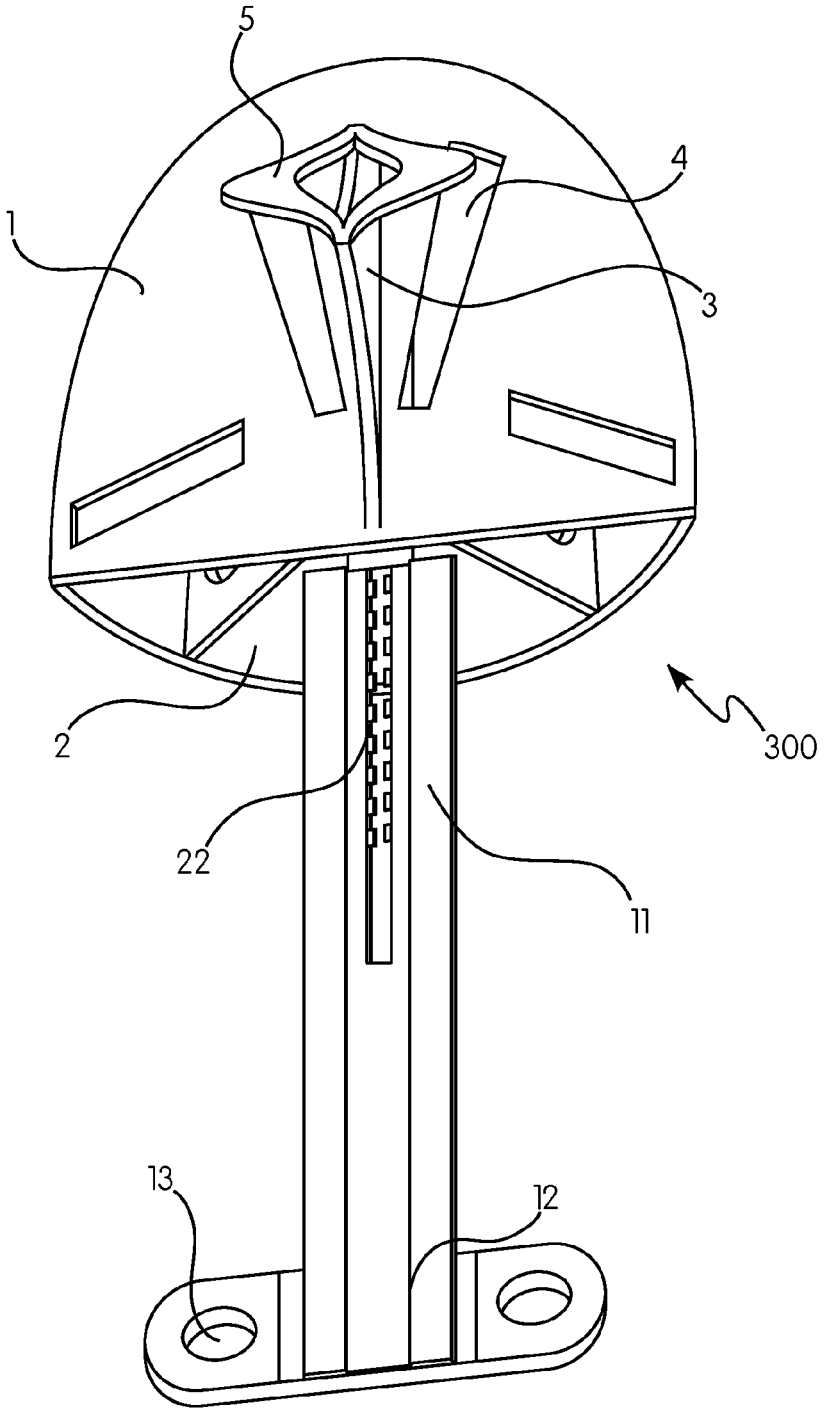
FIG. 6 is a rear perspective view of an aquatic training device having an elongated extension in accordance with yet another preferred embodiment of the present invention.
Figure 7:
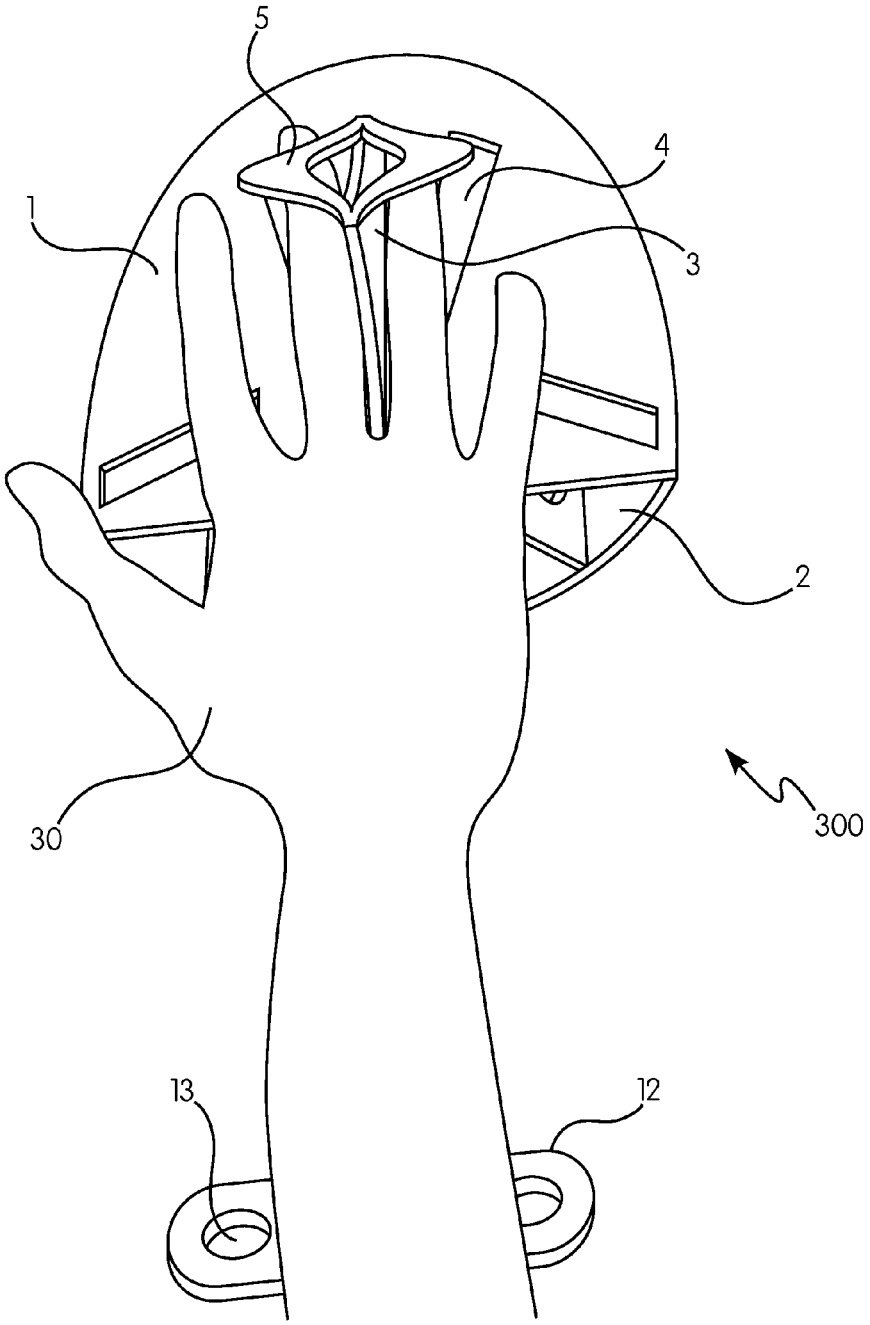
FIG. 7 is a rear perspective view of a user's hand on the aquatic training device of FIG. 6.

FIGS. 6 and 7 show a fourth preferred embodiment of an aquatic training device 300 in accordance with the present invention. The aquatic training device 300 is similar to aquatic training device 10 but includes an additional/optional posteriorly extending elongated extension 11 to prevent motion of the user's hand in relation to the user's forearm. The base 12 of the elongated extension 11 presses against the underside of the user's forearm to keep the user's hand fixed in a parallel alignment with the forearm, and in an optimal stroke position. FIG. 6 further shows possible attachment openings 13 on the elongated extension 11 to securely attach the elongated extension 11 to the user's forearm with an elastic or inelastic tether. The elongated extension 11 can optionally be adjusted closer or further away from the contact surface 1 to account for different hand and arm sizes with a track 22. Additionally, the elongated extension 11 can be retracted up into the paddle to such a degree as to allow the wrist to flex naturally. This ability would be helpful when a swimmer is using the paddle for a butterfly stroke and needs to flex their wrist during the outsweep of the stroke. To show the relation of the paddles to the user's forearm and fingers, FIG. 7 illustrates the use of the paddle by a user 30, with the fingers secured underneath the retaining member 5 and the wrist/forearm supported by the elongated extension 11 and its base 12.

As discussed above, another key design element of swim paddles that can be incorporated into the disclosed invention technology, is the use of the elongated extension 11. A key element to at least the initial catch phase of all four competitive swim strokes is the need for the swimmer to avoid excessively bending their wrist. To date all technology invented to train swimmers to keep their wrist straight are devices that very securely attach to the hand and forearm. Conventional devices force the user to swim correctly but do not teach or train the user in the proper technique when the forearm paddle is removed. As a further invention of the disclosed paddle technology, the elongated extension 11 can be removably attached to a range of paddle types in order to train the user in proper techniques both with and without the elongated extension 11. Additionally, the elongated extension 11 can be retracted far enough up into the paddle as to allow normal wrist flex, as would be needed for stroke technique such as the outsweep on a butterfly stroke. This allows the user to retract the elongated extension 11 so it is retained but not functioning. The invention of a removable and/or retractable elongated extension 11 allows swimmers to train with any type of paddle, such as enlarged surface area paddles, fin/glide paddles, resistive catch paddles, and displacement paddles, all with an elongated extension 11. Therefore an attachment mechanism can be added to any paddle type for adding the elongated extension 11 and potentially retracting the elongated extension into the paddle so as to remove the effect without removing the elongated extension.

Figure 8:
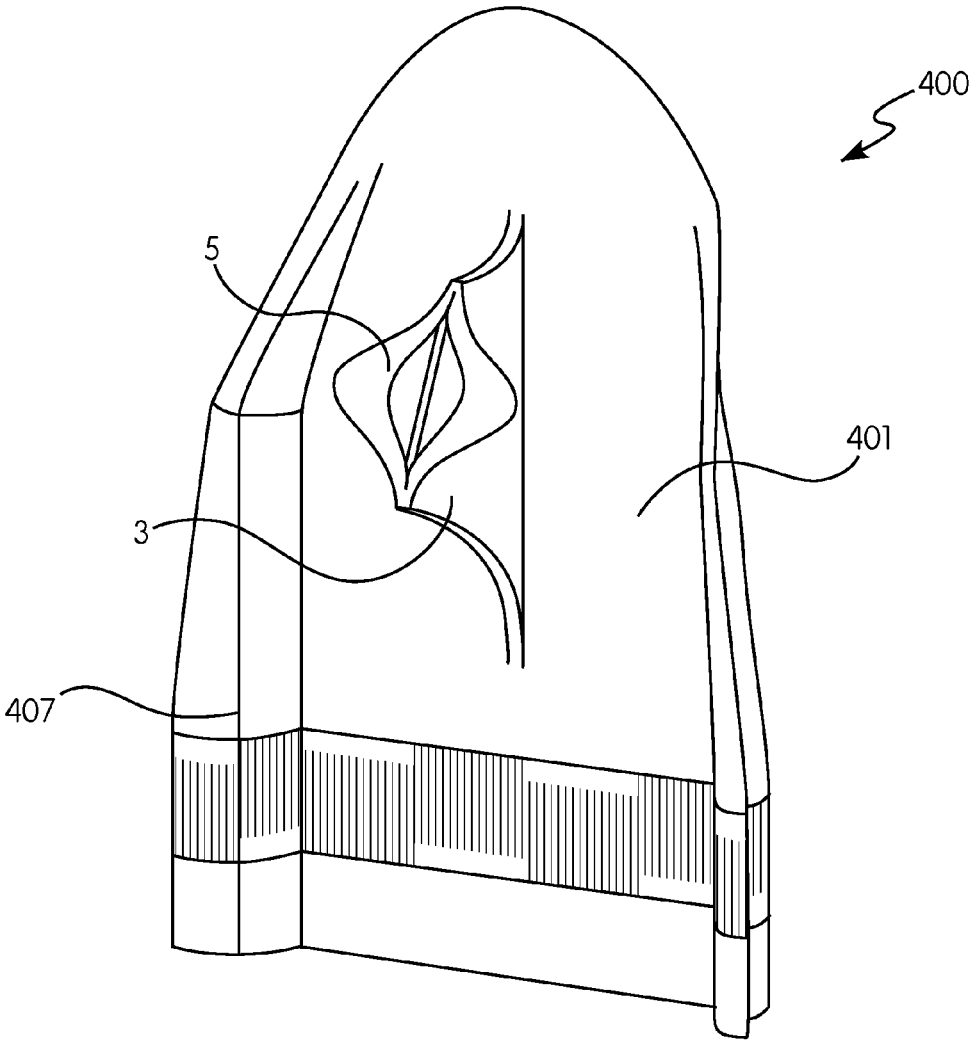
FIG. 8 is a perspective view of an aquatic training device in accordance with another embodiment of the present invention.

FIG. 8 illustrates a fifth preferred embodiment of an aquatic training device 400 in accordance with the present invention. The aquatic training device 400 is similar to the aquatic training device 10 but with lateral retaining members 407 on the perimeter of the paddle and a lengthening of the entire contact surface 401. This embodiment lacks the large cavity 21 of previously depicted resistive members 2 and instead includes a planar body. The increased surface area of the planar body increases perpendicular resistance in water in order to increase muscular condition, while the gripping fin 3 serving as a securing member and minimal resistance from the contact surface 401 allows the paddle to easily be equipped or removed by the user. Faster securing times increases utility for large groups of swimmers using this embodiment.

Figure 9:
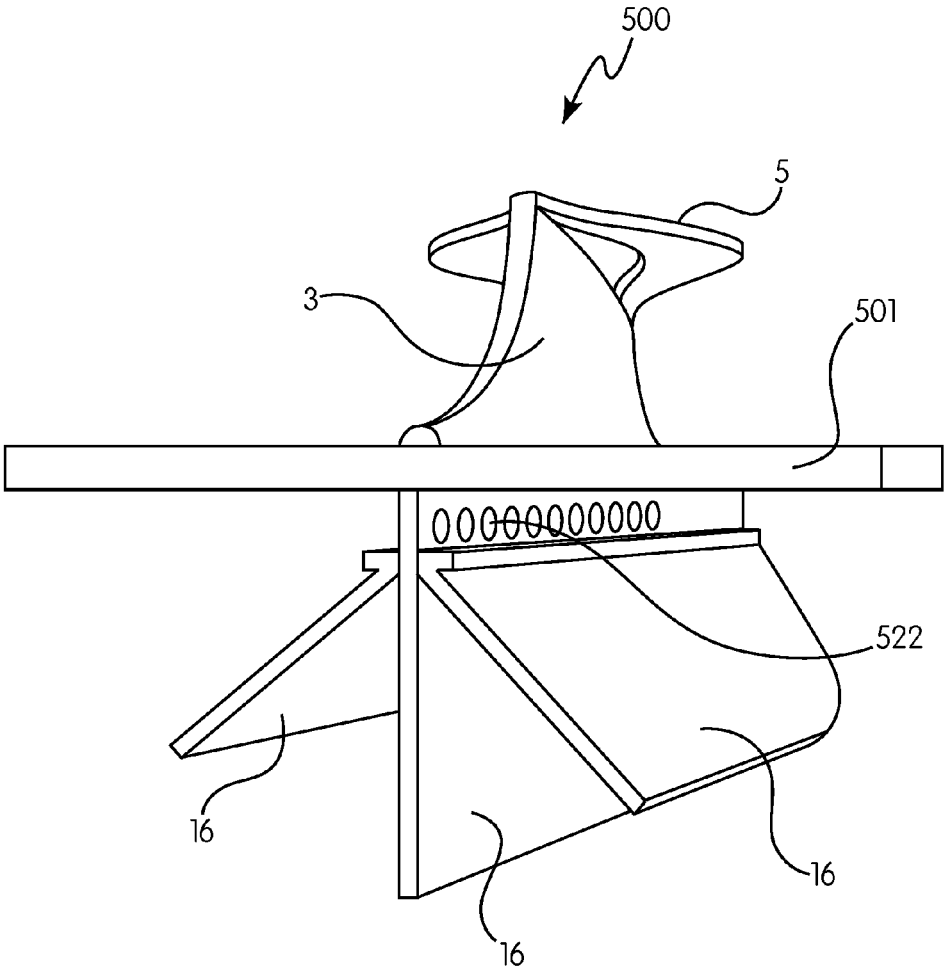
FIG. 9 is a rear perspective view of an aquatic training device in accordance with yet another embodiment of the present invention.

FIG. 9 illustrates a sixth preferred embodiment of an aquatic training device 500 in accordance with the present invention. The aquatic training device 500 is similar to the aquatic training device 10 but additionally includes a series of fins 16 under the contact surface 501. The fins 16 include a vertical fin and two angled fins, all of which function to keep the user's hand position firm and straight in the water. Such paddles are useful in swimming to keep a user's hands from moving laterally (orthogonal to the direction of movement) while swimming. The securing member 3 allows more lateral side movement to reinforce an incorrect lateral drift in the paddle direction. The incorrect lateral movement can be further reinforced by the disclosed triple fins 16 which trap more water for a higher level of lateral resistive forces. The embodiment in FIG. 9 employs a gripping fin 3 as a securing member, showing a further possible use of the present invention in modern swimming training. Additionally, the disclosed paddle design incorporates a track 522 which can interlock with the elongated extension 11 shown in FIGS. 6 and 10, illustrating a further value of the disclosed retractable and/or removable elongated extension 11.

Other paddle designs can also use the disclosed securing members for enhanced stroke technique feedback and for ease of securing to the hand. A paddle utilizing one or more fins 16 on the lower surface can be designed to include the disclosed securing member whereby the paddle is allowed more movement than traditionally is possible with securing members that affix the hand too tightly to the contact surface 501. A paddle with (a) forward aligned fin(s) 16 can be an ideal mechanism for detecting incorrect lateral movements of the stroke plane by providing lateral resistance. This is particularly important with the crawl stroke during the catch phase at the start of a stroke. When breathing during the crawl stroke, a common problem is to allow the leading hand to move laterally in either direction to support the swimmer as they breathe. A paddle with one or more fins 16 on the bottom surface can help correct such improper stroke techniques by providing negative reinforcement through a resistive force to the lateral movement. The improper technique can be detected by enhancing the fin(s) 16 to better capture lateral forces as well as providing a securing member such as the disclosed technology. By incorporating a securing member that does not secure the hand too firmly to the contact surface 501 of the paddle, improper techniques can be more readily detected by the user when the hand is relaxed and the paddle is free to have additional movement in the direction of the improper stroke technique.

Figure 10:
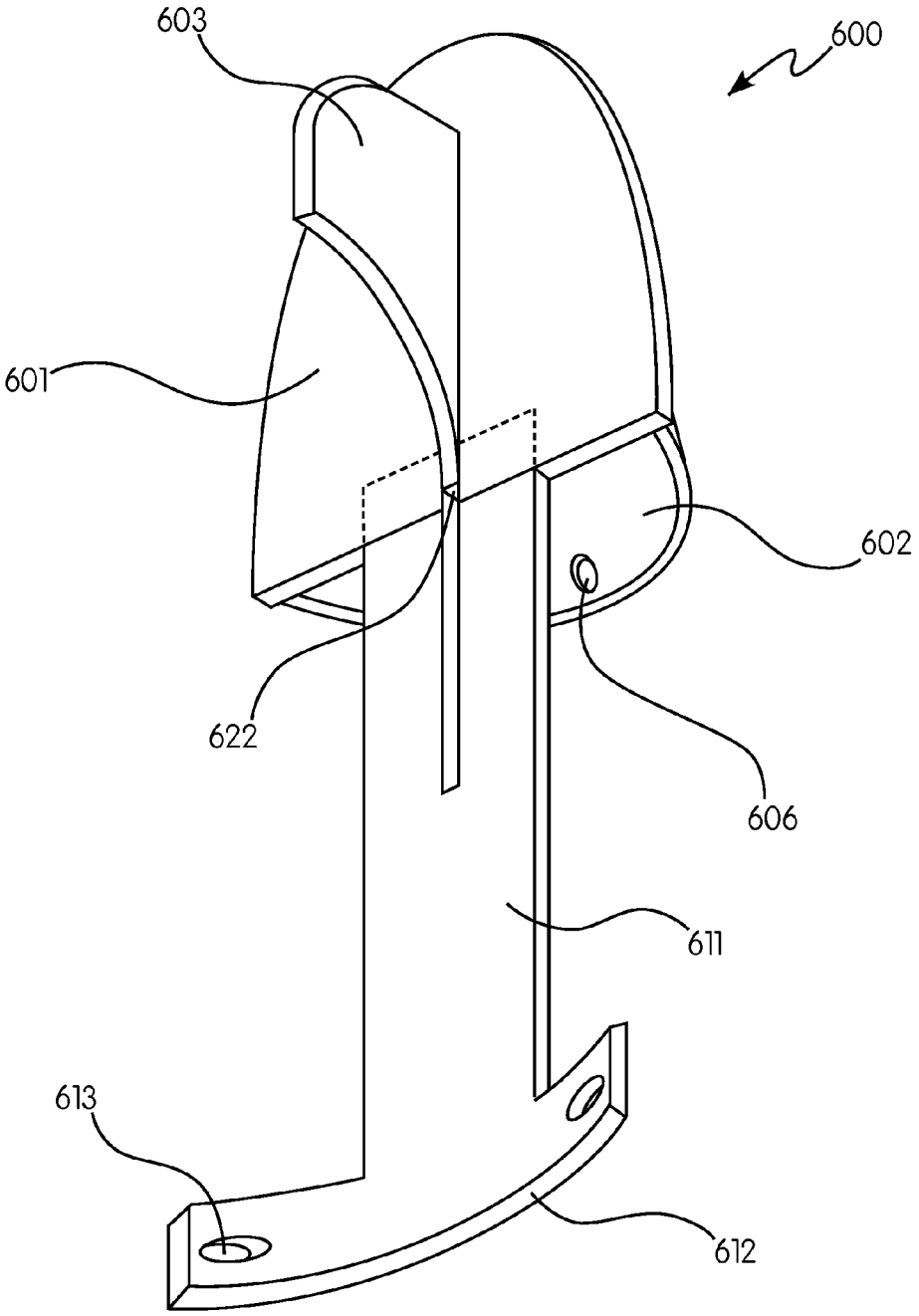
FIG. 10 is a perspective view of an aquatic training device in accordance with another embodiment of the present invention.

FIG. 10 illustrates a seventh preferred embodiment of an aquatic training device 600 in accordance with the present invention. The aquatic training device 600 is similar to the aquatic training device 10 but depicts an additional version of the elongated extension 611 in FIG. 6, including a concave shaped base 612 that is curved to better fit the user's forearm. The elongated extension 611 can be detached from any range of paddles. It also incorporates a track 622 allowing it to be retracted up into any number of paddles in order to retract close enough to the wrist to allow full flexibility when desired, or extended to match the body size of the user for optimum distance for preventing the wrist flexing. FIG. 10 further shows possible attachment openings 606 on the resistive member 602 and attachment openings 613 on the elongated extension 611 to allow attachment of an elastic or inelastic tether to secure the paddle to the body in order to avoid completely detaching from the body when used incorrectly.

FIG. 10 further includes a securing member configured as a gripping fin 603 having an increased thickness along its lower and upper edges. The increased thickness of the gripping fin 603 provides the ability for the contact surface 601 to move back to a secondary position on the hand when the paddle is used incorrectly. The increased thickness of the lower edge helps prevent the paddle from becoming detached by allowing the knuckles to squeeze on the increased thickness when the resistive member 602 is engaged due to excess parallel movement of the paddle along the contact surface 601. Alternatively, the increased thickness along the upper edge of the gripping fin 603 can help prevent the paddle from completely disengaging from the hand when the perpendicular forces on the paddle are too great. Such an excessive perpendicular force can occur during the initiation of the outsweep of a stroke when the paddle is still full of water as it is recovered through the air.

A further function of the directional securing means and the force from the resistive member 602 involves more than one resistive force. As discussed previously, the additional force from the resistive member 602 on a first directional securing means can cause motion of the hand in relation to the paddle. Instead of losing contact entirely between the hand and contact surface 601, the motion can be ended by an additional directional securing means that can secure the user to the contact surface 601 at a different location from the first securing means. This creates an optimal position on the contact surface 601 and a second location that the hand and/or fingers will move to if stroke position is improper and parallel to the user's movement. More positions can be added to increase the monitoring ability of the user. The user may return to the first optimal position to constantly monitor stroke technique without interrupting strokes. An example of an additional directional securing means can include an increased thickness on the backside of the gripping fin 603 that rests between any two fingers as they rest on the contact surface 601. The increased thickness of the gripping fin 603 can help the user to apply additional pressure and prevent the hand from sliding completely off the contact surface 601 when the knuckles are restricted from sliding past the increased thickness. Thicknesses that are increased by as much as 1 mm can provide a squeeze point for the knuckles for additional securing means. The additional thicknesses can be designed to be behind the holding position or above it in order to prevent a paddle from becoming disengaged from the hand by sliding off the front of the hand or from below the hand. An ideal increased thickness for such a squeeze point can be 1.5 mm up to 3.00 mm of added thickness, depending on the location and other design factors. Increased thickness for lateral retaining members 7 that are located adjacent to the perimeter edge(s) of the hand or finger(s) will often need to have a greater increased thickness than 1.5 mm and possibly as high as 10 mm additional wall thickness.

Figure 11:
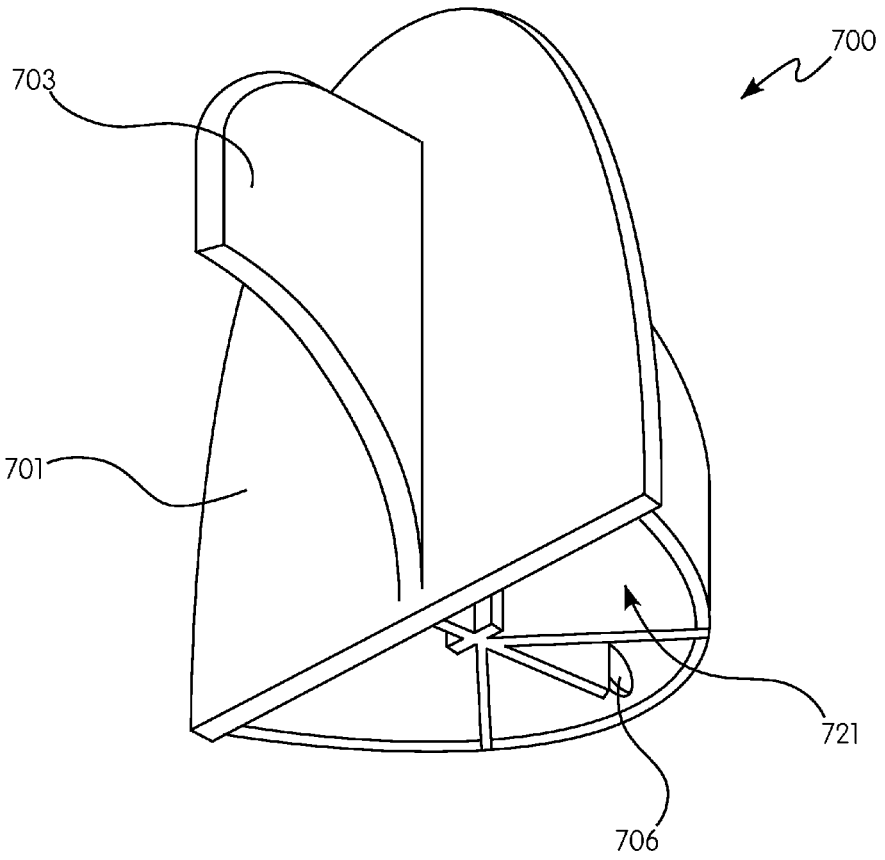
FIG. 11 is a rear perspective view of an aquatic training device in accordance with another embodiment of the present invention.
Figure 12:
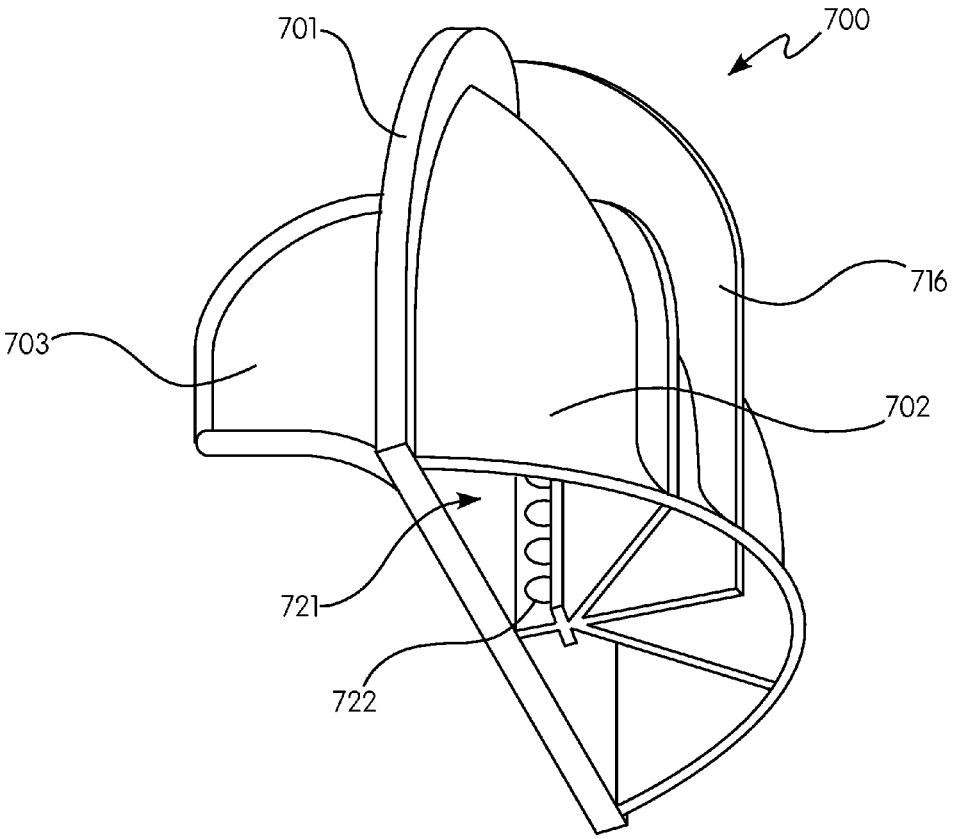
FIG. 12 is a side perspective view of the aquatic training device of FIG. 11.

FIGS. 11 and 12 show an eighth preferred embodiment of an aquatic training device 700 in accordance with the present invention. The aquatic training device 700 is similar to aquatic training device 10 but combines several of the previously discussed concepts. A resistive member 702 with cavity 721, the gripping fin 703, and the fins 716 to provide lateral glide feedback while swimming are all present, combining multiple benefits from the gripping fin 703 and the resistive member 702. In this embodiment the resistive member 702 with cavity 721 has an increased area for the opening of the cavity 721. The rounded characteristic of the discussed resistive member 702 displaces water more easily than flat paddles. This represents a form of displacement paddle which is used to reduce the amount of effective force capable by the user's hand and encourage the user to generate more propulsion from the combination of the hands, wrists, and forearms. Attachment openings 706 on the resistive member 702 allow attachment of an elastic or inelastic tether to secure the paddle to the body in order to avoid completely detaching from the body when used incorrectly. Additionally, the disclosed paddle design incorporates a track 722 which can interlock with the elongated extension 11 shown in FIGS. 6 and 10, illustrating a further value of the disclosed retractable and/or removable elongated extension 11. Increased thickness or an added structure to the back of the vertical section of the gripping fin 703 as well as the increased thickness along the upper portions of the gripping fin 703 increases the function of the gripping fin 703. In this embodiment, the contact surface 701 is thicker than previously discussed embodiments which allows a hollow center across the contact surface 701. Air trapped within the cavity 721 will increase the paddle's buoyancy in water and prevent against sinking, making the paddle easier to locate if it comes detached from the hand. This feature can aid in the recovery of paddles if they are dropped or lost while swimming.

Figure 13:
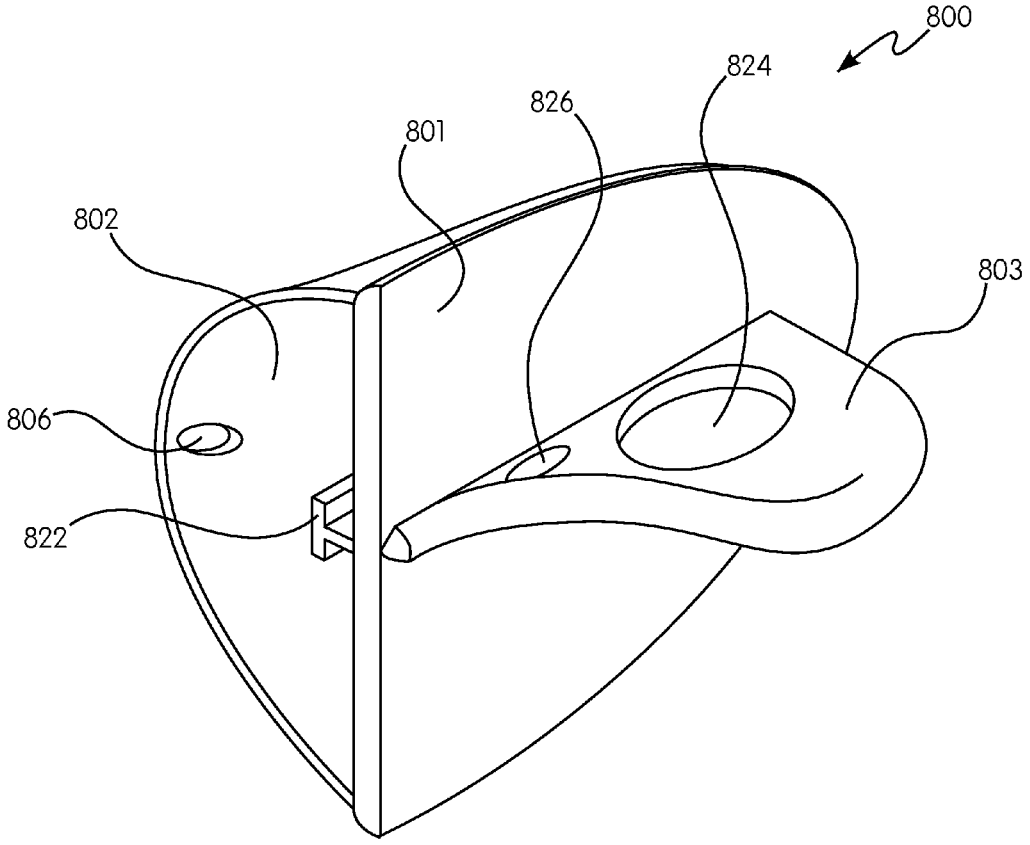
FIG. 13 is a top perspective view of an aquatic training device in accordance with yet another embodiment of the present invention.

FIG. 13 depicts a ninth preferred embodiment of an aquatic training device 800 in accordance with the present invention. The aquatic training device 800 is similar to aquatic training device 10 but has a gripping fin 803 wherein a portion of the hand such as the knuckles can press through the gripping fin 803 but still slide back to an additional position(s). The gripping fin 803 incorporates an aperture 824 which allows two opposing knuckles to extend through the gripping fin 803. The back side of the aperture 824 acts as a resistance force to prevent the hand from sliding back on the contact surface 801. If enough resistive force is applied at least partially parallel to the contact surface, the resistance applied to the back of the aperture 824 is overcome and the knuckles will slide back onto the gripping fin 803 for a second position of the hand on the contact surface 801. The increased thickness on the back side of the gripping fin 803 will act as an additional resistive force to prevent the hand from completely releasing contact with the contact surface 801. When enough resistive forces are applied at least partially parallel to the contact surface 801 to remove the hand from the contact surface 801, the hand can be secured by a tether, a rope, or a strapping material to openings such as aperture 826 in the gripping fin 803 or the attachment opening 806 positioned about a lower surface of the cavity of the resistive member 802. Additionally, the disclosed paddle design incorporates a track 822 which can interlock with the elongated extension 11 shown in FIGS. 6 and 10, illustrating a further value of the disclosed retractable and/or removable elongated extension 11.

FIGS. 14 and 15 depict a tenth preferred embodiment of an aquatic training device 900 in accordance with the present invention. The aquatic training device 900 is similar to the aquatic training device 10 having a paddle with a similar gripping fin 903, retaining member 905 and a track 922 but with a contact surface 901 which is half the size of the previously discussed contact surfaces. This reduced size surface only supports the user's fourth and fifth digits (ring and pinkie fingers) while forcing the remaining fingers to support themselves. This emphasis on only the fourth and fifth fingers emphasizes the efforts by certain muscles of the user while swimming, particularly the latissimi dorsi muscles and key forearm muscles. Specifically, the gripping fin 903 is now positioned along a lateral side of the aquatic training device contact surface.

Figure 16:
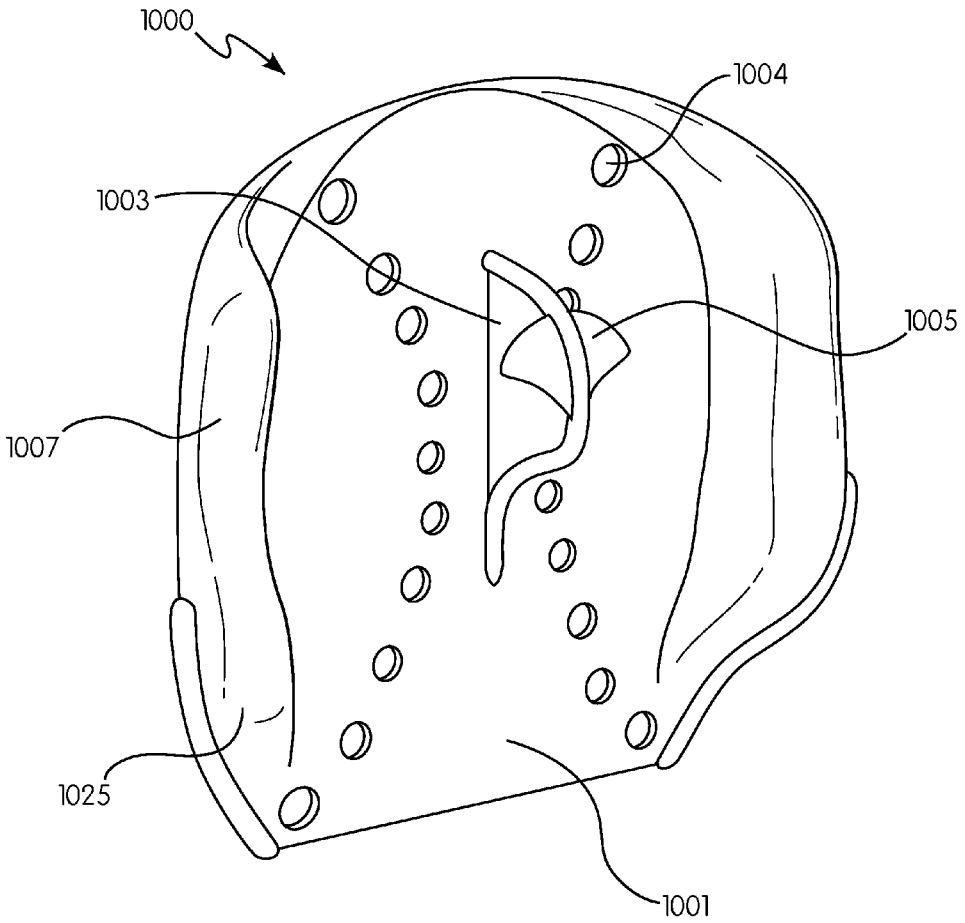
FIG. 16 is a perspective view of an aquatic training device in accordance with yet another preferred embodiment of the present invention.
Figure 17:
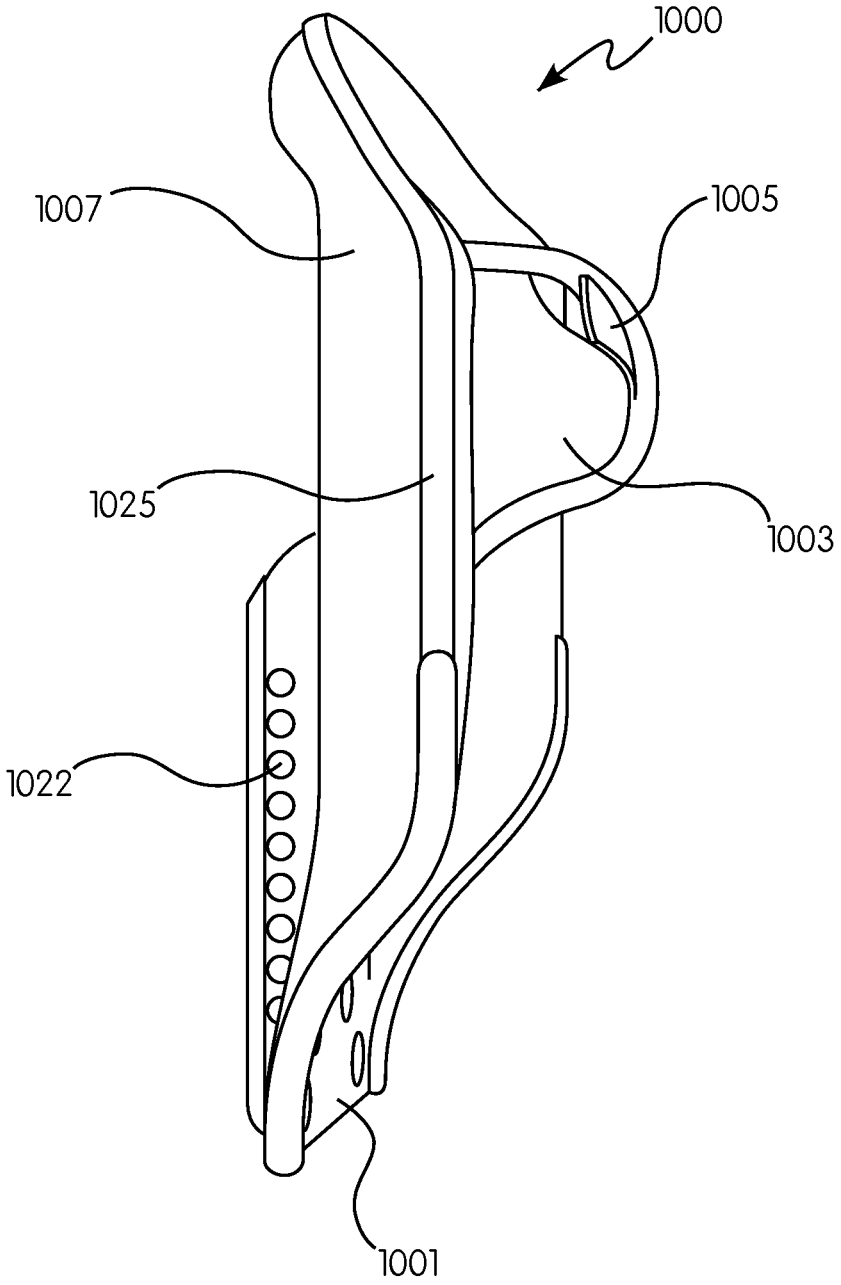
FIG. 17 is a side view of the aquatic training device of FIG. 16.

FIGS. 16 and 17 show an eleventh preferred embodiment of an aquatic training device 1000 in accordance with the present invention. The aquatic training device 1000 is similar to the aquatic training device 10 with a similar gripping fin 1003 and retaining member 1005 but depicts another aspect of the lateral retaining members 1007 previously discussed. The lateral retaining members 1007 depicted in FIGS. 16 and 17 include an additional outward arch 1025 about an upper end of the lateral retaining members 1007 which cups downward to catch additional water. This added resistance and hydraulic entrapment adds stability to the paddle, reducing the tendency present in many other paddles to shift dramatically to both sides during the power phase of the strokes. Additionally, there are a plurality of openings 1004 configured as apertures in the contact surface 1001 that function to allow water to come in contact with the user's hand and/or fingers. This movement of water increases as the motion of the paddle is more parallel to the contact surface 1001, providing stimulus for the swimmer indicating improper stroke position. Additionally, the disclosed paddle design incorporates a track 1022 which can interlock with the elongated extension 11 shown in FIGS. 6 and 10, illustrating a further value of the disclosed retractable and/or removable elongated extension 11.

Figure 18:
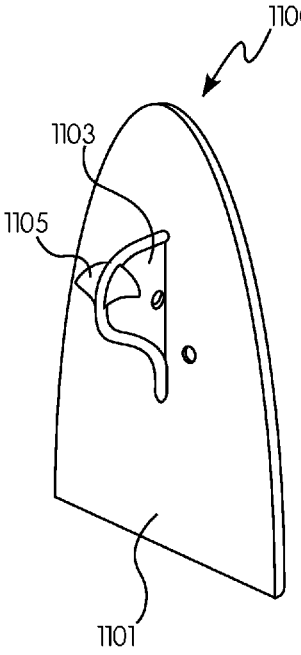
FIG. 18 is a top perspective view of an aquatic training device in accordance with another embodiment of the present invention.
Figure 19:
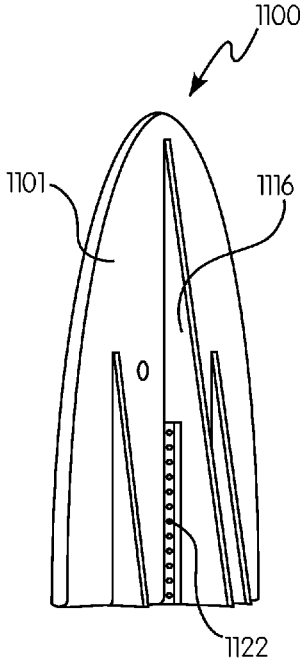
FIG. 19 is a bottom perspective view of the aquatic training device of FIG. 18.
Figure 20:
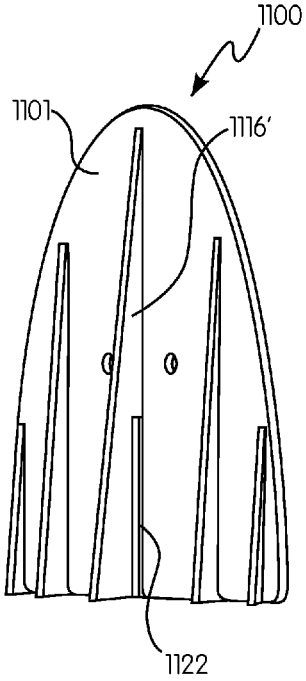
FIG. 20 is a bottom perspective view of the aquatic training device of FIG. 18 in accordance with another aspect of the present embodiment.

FIGS. 18-20 depict a twelfth preferred embodiment of an aquatic training device 1100 in accordance with the present invention. The aquatic training device 1100 is similar to the aquatic training device 10 with contact surface 1101, gripping fin 1103 and retaining member 1105 but includes added resistance and hydraulic entrapment, in which fins 1116 on the underside of the paddle entrap water to provide added horizontal stability through this hydraulic entrapment. Two possible embodiments are shown, with three and five fins 1116', respectively. Additionally, the disclosed paddle embodiments incorporate a track 1122 which can interlock with the elongated extension 11 shown in FIGS. 6 and 10, illustrating a further value of the disclosed retractable and/or removable elongated extension 11.

Figure 21:
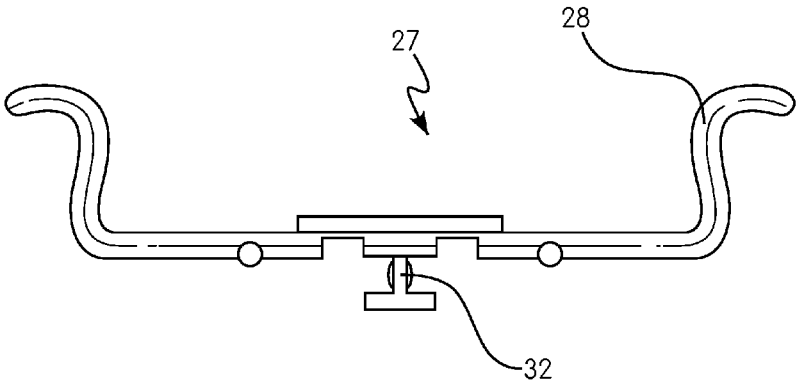
FIG. 21 is a front view of a first aspect of a baffle of an elongated extension of the aquatic training device of FIG. 6.
Figure 22:
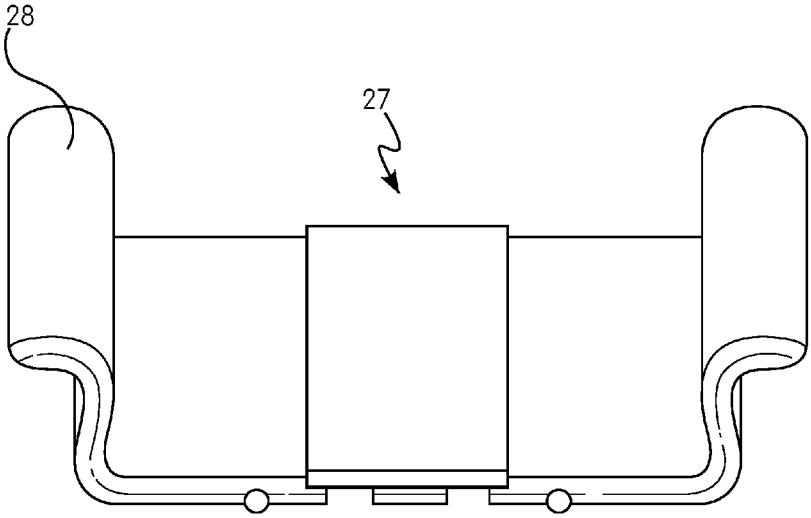
FIG. 22 is a perspective view of the baffle of FIG. 21.
Figure 23:
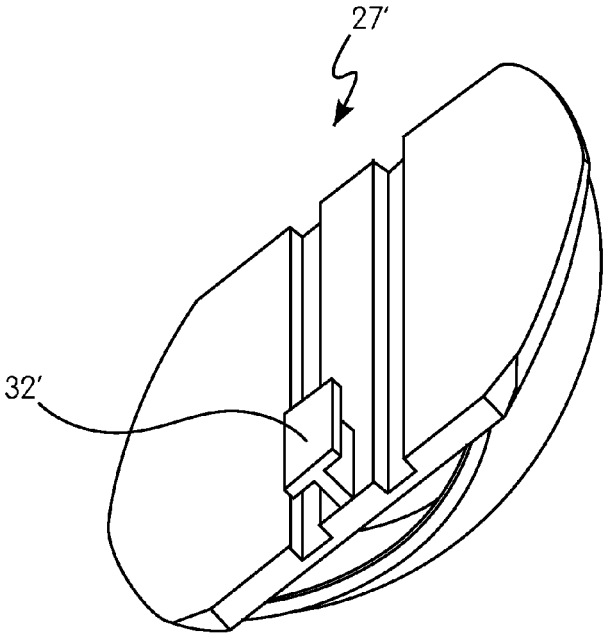
FIG. 23 is a perspective view of a second aspect of a baffle of an elongated extension of the aquatic training device of FIG. 6.
Figure 24:
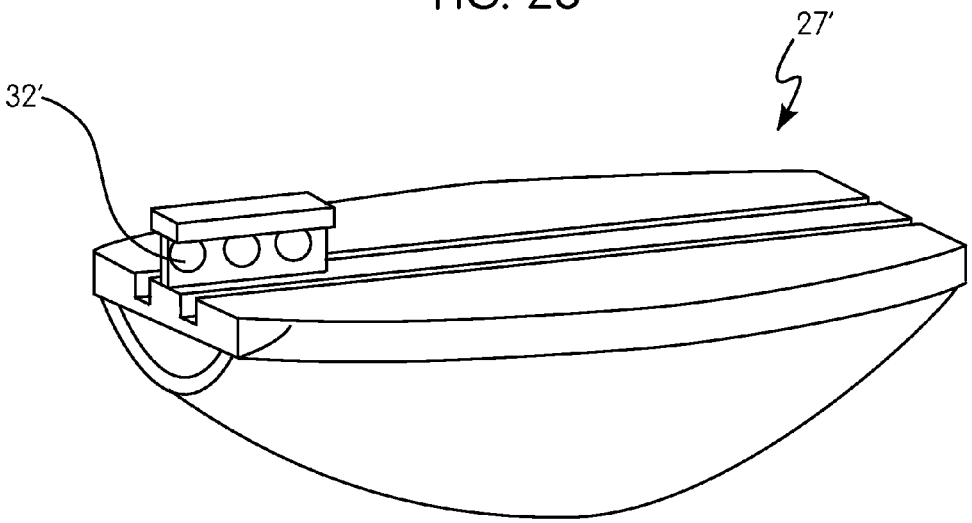
FIG. 24 is a side perspective view of the baffle of FIG. 23.

A further application of the present invention is illustrated in FIGS. 21 and 22, which shows a baffle 27 with a track attachment 32 which can be slidably attached to the previously discussed elongated extension 11 (see FIG. 6) to provide added force from the added surface area to the paddle. The baffle 27 and curved lateral retaining members 28 create a downward cup to entrap water for support. Alternatively, the baffle can be configured as shown in FIGS. 23 and 24. The baffle 27' of FIGS. 23 and 24 similarly can be slidably attached to the previously discussed elongated extension 11 (see FIG. 6) with a similar track attachment 32'. The baffle 27' shown in FIGS. 23 and 24 is substantially rounded to displace water around the user's wrist, thereby decreasing the effective force to encourage proper stroke technique. As shown in FIGS. 21-24, the baffle can slidably attach to a track 22 on the elongated extension 11 and can be configured as a substantially U-shaped member 27 or a substantially hemispherical shaped member 27'.

Possible further embodiments of this removable and/or adjustable elongated extension 11 could be additional adjustable and/or removable components serving different functions. By securing a component which increases the effective force from using the paddle, the invention allows for more powerful training in increased speeds and/or increased muscular efforts expended by the user. Paddles with similar functions are common in the industry, and they are often a core training and strengthening element for many levels of swimmers. The added component of this invention is secured in such a manner as to maximize the forces applied by the user when swimming; this can be achieved by increasing normal surface area and/or forming a semi-enclosed volume which traps water to create a temporary volume of hydraulic pressure. While this "power pad", e.g., baffle 27, as it is referred to is meant to increase the effective forces involved in a user's swim strokes, a different component may be instead added and used to decrease these effective forces. A baffle with a concave surface which curves towards the user's wrist and/or hand displaces the force of the user's swim strokes, reducing the total force involved with the region of the user's arm/hand covered by this surface. Adding such a component performs functions similar to the displacement functions described previously, which force the user to focus on powering their stroke through other areas of the arm which have no displacement added. Such a feature is commonly sought to maximize the force of a user's stroke by using the entire arm instead of merely the hand/wrist. Both of these two described components allow further variation in swim technique and strength training in a single paddle system than standard swimming paddles.

Figure 25:
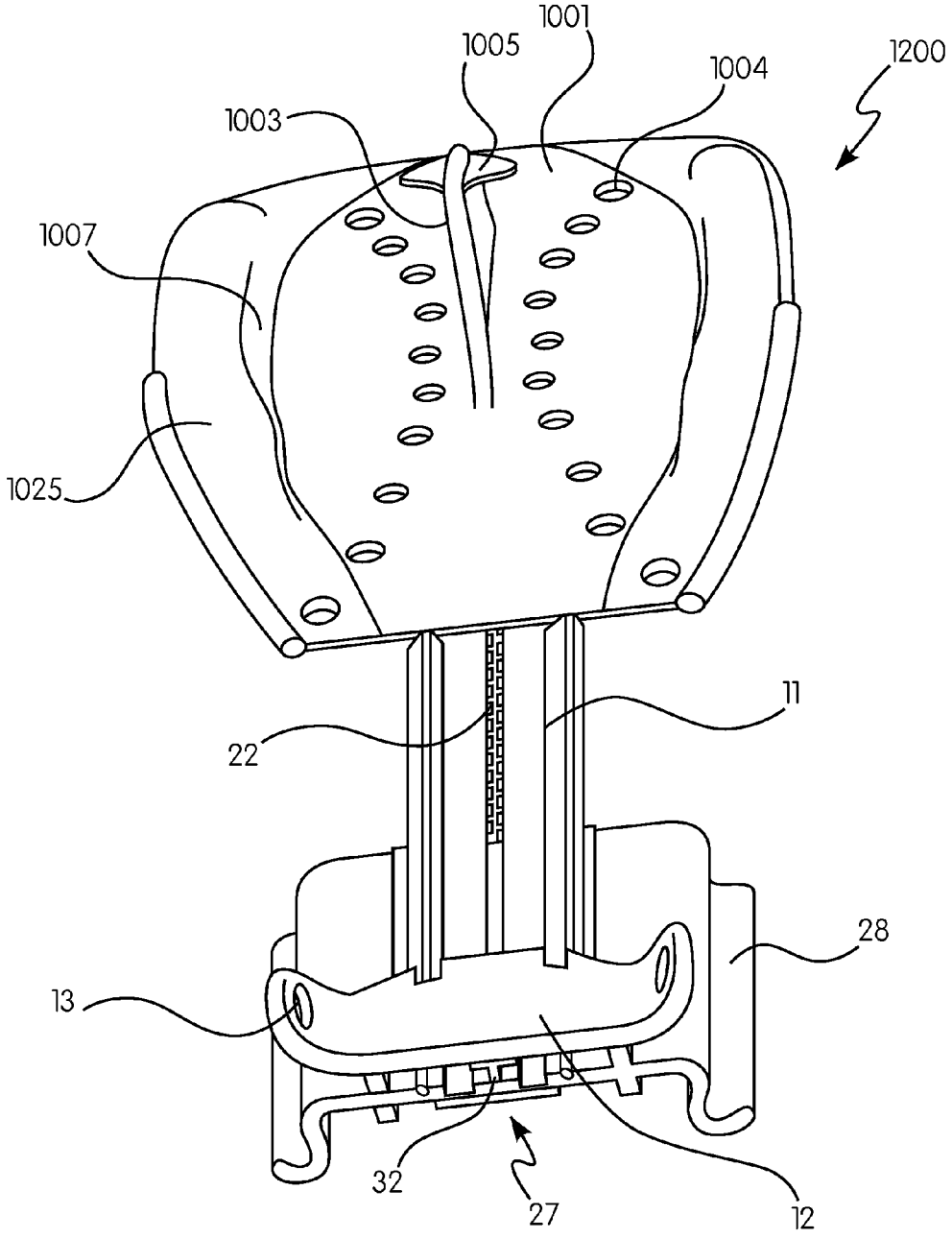
FIG. 25 is a perspective view of an aquatic training device in accordance with yet another preferred embodiment of the present invention.
Figure 26:
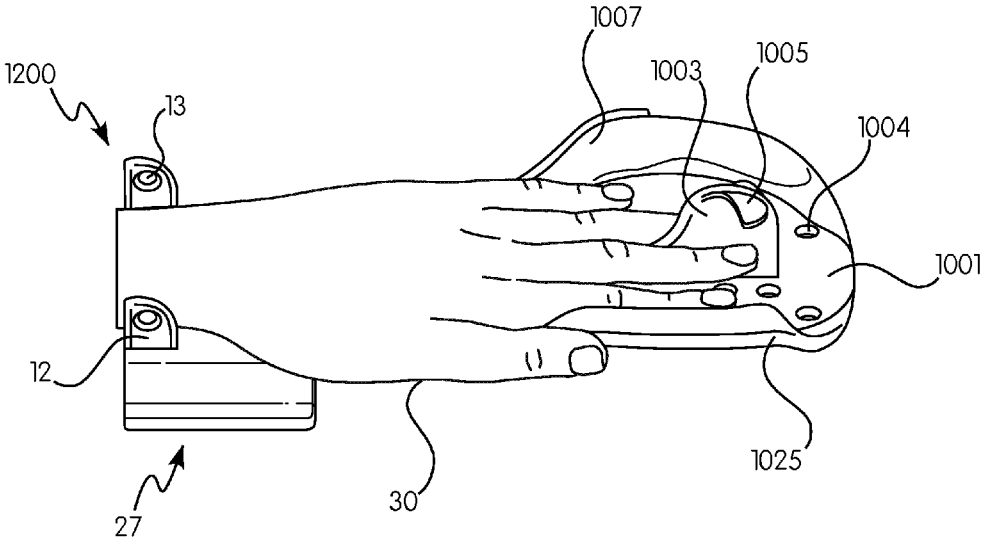
FIG. 26 is a side perspective view of a user's hand on the aquatic training device of FIG. 25.

FIGS. 25 and 26 show a thirteenth preferred embodiment of an aquatic training device 1200 in accordance with the present invention. The aquatic training device 1200 is similar to the aquatic training device 10 but includes the baffle 27 previously described and depicted in FIGS. 21 and 22, the components of the aquatic training device 1000 previously described and depicted in FIGS. 16 and 17, and the elongated extension 11 previously described and depicted in FIG. 6. Included in FIG. 26 is a user's hand 30 oriented relative to the gripping fin 1003, retaining member 1005, elongated extension 11 and base 12.

In sum, the present invention provides embodiments of an aquatic training device as configured and shown in FIGS. 1-7 and 10-13. The aquatic training device includes a hollow body and a dorsal fin-like member. The hollow body includes a top surface, a closed anterior end, and an open posterior end. The dorsal fin-like member extends from the top surface for engaging between fingers of a user's hand. The dorsal fin-like member further includes a retaining flap extending from a dorsal end of the dorsal fin-like member. An anterior end of the top surface has a parabolic shape. As shown in FIG. 11, the hollow body of the aquatic training device may include a curved bottom surface and at least one inwardly extending fin.

Alternatively expressed, the present invention provides embodiments of an aquatic training device as configured and shown in FIGS. 1-4, 6-9, 14-20, 25 and 26. The aquatic training device includes a body having a top surface and bottom surface. The aquatic training device further includes a dorsal fin-like member extending from the top surface for engaging between fingers of a user's hand and a retaining flap extending from a dorsal end of the dorsal fin-like member. As shown in FIG. 9, the aquatic training device may further include a plurality of fins extending from the bottom surface of the body.

In sum, the securing members and securing elements can pertain to three or more positions. The first position pertains to the optimum orientation of the hand on the paddle contact surface 1. The secondary position(s) pertain to one or more position(s) that are not optimal but still remain substantially contacting the contact surface 1. The one or more secondary position(s) inform the users of improper stroke techniques without relinquishing at least partial contact with the paddle. The final position(s) pertain to the loss of contact with the paddle. The preferred embodiment of the final position would pertain to any form of securing element such as a strap or band which can prevent the paddle from completely detaching from the body, even though it does not continue to have contact with the hand.

Additionally, other paddle designs can utilize the disclosed securing member and securing elements simply as a more convenient and quicker means of attaching the paddle to the hand. Many securing members and paddle designs require a different paddle for the left hand than for the right hand. The disclosed securing member can eliminate the need for the user to waste time searching for the correct paddle for each hand. Additionally the use of tubing, elastics, and hook and loop straps require considerable time to secure to the hand. The disclosed invention eliminates such difficulties. Therefore traditional paddles that are merely designed to enlarge the surface of the hand in an effort to strengthen the user's muscles, can be more quickly attached to the hand with disclosed securing member. In many cases, the securing member can help users of said paddles by providing movement of the paddle when the stroke technique is improper. This provides both the convenience of a faster and easier securing member while still helping to provide stroke technique feedback with even the most basic paddle designs.

An additional paddle design that can be greatly enhanced by the use of the securing member is the displacement paddle. In order to reduce the resistive forces applied to the palm of the hand, displacement paddle designs provide a rounded angled lower surface of the paddle. A rounded or angled lower paddle surface will substantially displace the water from the surface of the hand and cause the water to flow with less resistance around the hand. By reducing the resistance applied to the hand, the user is forced to focus on a proper stroke by aligning the forearm more vertically as a means of forward propulsion. The displacement paddles that are currently available are different for left and right hands making them difficult to select which wastes time. Current commercial displacement paddles are also attached with tubing which can be attached to the hand too tightly. By incorporating the disclosed securing member, displacement paddles can be quick to attach to the hand and can provide negative reinforcement to the user when they engage their stroke in a direction that is parallel to the forward motion instead of the desired perpendicular movement which engages both the hand and the forearm. By combining such displacement paddles with the disclosed securing member the swimmer is not only trained by displacing the water from around the hand but also by providing movement between the paddle and the hand when the stroke is parallel to the contact surface. Therefore, the disclosed securing member provides an ideal way to enhance existing paddle technology such as power paddles, displacement paddles, and fin/glide paddles.

Many of the industry's current paddle designs also show instability while in use; namely, these top industry designs force the user's hands to shift laterally when moving through the water. This lateral motion is embodied as short and swift movements to the left or right of the user's hand, caused by instability in a paddle's design when moving through water and therefore under force. The current invention as described may contain mechanisms to prevent or at least diminish this instability in many possible embodiments. Several mechanisms, e.g., the resistive member 2 with cavity 21 and baffle 27, may be used to form a semi-enclosed volume which prevents and/or hinders water flow in at least two of the axial directions. By forming this volume so that water may enter in a direction parallel to the force of the user's hand through the water, the volume slows and entraps water when in use through the water. This forms a volume of hydraulic pressure at key areas on the paddle; the added resistance to motion through water not only increases the strength training of users but also vastly increases the stability of the paddle in reference to lateral motions. This system of hydraulic entrapment can be accomplished through the numerous embodiments. The lateral retaining members 7 previously discussed on the exterior edge of the paddle may be curved back downward to form a volume on the edges of the paddle. The baffle 27 previously described which increases the effective force of the paddle system can also form a degree of hydraulic entrapment with a semi-enclosed volume. Many industry paddles also include fins 16 running parallel to the user's fingers on the bottom of the paddle; this is an attempt to stabilize the paddle. However, unique to the industry is an embodiment of the current invention which includes more than one of these fins 16, which not only stabilize the paddle as others do but also form a volume of hydraulic entrapment between the fins 16 which vastly increase the stability.

Any of the above described embodiments can be employed alone or in any combination to provide a method for training proper stroke techniques for users. With any combination of resistive members, plus the disclosed securing member, the severity of improper techniques can be constantly monitored by the user. Minor mistakes or motion that is only slightly parallel to forward motion can be monitored through the water stimuli through the contact surface 1 or from movement of the hand over a textured contact surface. Larger mistakes or larger degrees of parallel hand motion can cause the paddle to shift and/or move in relation to the user's hand, providing a more direct stimulus regarding technique. For motion that is mostly parallel to the user's movement, the paddle can completely lose contact with the user to prevent continued use.

The described embodiments can also be employed across different experience levels of individual swimmers. A paddle that will lose contact with the user for improper stroke technique can quickly reinforce proper stroke techniques in beginner swimmers and prevent the development of improper strokes. Slight movements of the hand paddle for improper strokes could assist moderately experienced swimmers in maintaining proper techniques. Water stimuli through the contact surface 1 could aid advanced swimmers in adjusting and monitoring smaller details in swim technique.

It will be appreciated by those skilled in the art that changes could be made to the embodiments described above without departing from the broad inventive concept thereof. It is to be understood, therefore, that the present invention is not limited to the particular embodiments disclosed, but it is intended to cover modifications within the spirit and scope of the present invention as defined by the appended claims.

What is claimed is:

1. An aquatic training device comprising:

a body having a contact surface for engaging a hand of a user;

a securing fin extending substantially transverse from the contact surface and including a retaining member, wherein the retaining member is spaced from the contact surface and wherein the securing fin is an elongated substantially planar fin that extends linearly along a longitudinal extent of the body; and a resistive member adjacent to and extending along a lateral side of a planar surface opposite the contact surface.

2. The aquatic training device of claim 1, further comprising a tether attachable to the resistive member for securing the aquatic training device to a user's hand or forearm.

3. The aquatic training device of claim 1, wherein the securing fin has a substantially T-shaped longitudinal cross-section.

4. The aquatic training device of claim 1, wherein the retaining member extends from the securing fin at an angle about a dorsal end of the securing fin.

5. The aquatic training device of claim 1, further comprising a pair of lateral retaining members extending from opposite lateral ends of the contact surface.

6. The aquatic training device of claim 5, wherein the lateral retaining members include a coupling member for connecting the lateral retaining members together.

7. The aquatic training device of claim 5, wherein the lateral retaining members have a generally curvilinear longitudinal cross-sectional profile.

8. The aquatic training device of claim 1, further comprising an elongated extension extending from a posterior end of the body for supporting a forearm of the user.

9. The aquatic training device of claim 8, wherein the elongated extension is slidably attached to the body.

10. The aquatic training device of claim 8, wherein the elongated extension further comprises a securing element for securing the elongated extension to a user.

11. The aquatic training device of claim 10, wherein the securing element is a tether, a rope, or a strapping material.

12. The aquatic training device of claim 8, wherein the elongated extension includes a concave shaped base about a posterior end.

13. The aquatic training device of claim 8, wherein the elongated extension further comprises a baffle slidably attached to the elongated extension.

14. The aquatic training device of claim 13, wherein the baffle is substantially U-shaped or substantially hemispherical shaped.

15. An aquatic training device comprising:

a top surface and a bottom surface extending from a surface opposite the top surface defining a hollow body; and a dorsal fin-like member extending from the top surface for engaging between fingers of a user's hand, wherein the dorsal fin-like member includes a retaining flap extending from a dorsal end of the dorsal fin-like member.

16. The aquatic training device of claim 15, wherein an anterior end of the top surface has a parabolic shape.

17. The aquatic training device of claim 15, wherein the hollow body further comprises at least one inwardly extending fin.

18. The aquatic training device of claim 15, wherein the bottom surface is a curved bottom surface.

19. The aquatic training device of claim 15, wherein the hollow body further comprises a closed anterior end, closed side portions, and an open posterior end.

20. The aquatic training device of claim 15, wherein the hollow body is a rigid hollow body.

21. An aquatic training device comprising:

a body having a contact surface for engaging a hand of a user;

a securing fin extending substantially transverse from the contact surface, wherein the securing fin includes a retaining member spaced from the contact surface; and an elongated extension extending from a posterior end of the body for supporting a forearm of the user, wherein the elongated extension includes a baffle slidably attached to a track on the elongated extension.

22. The aquatic training device of claim 1, wherein the securing fin has a longitudinal extension greater than a majority of the longitudinal extent of the body.

* * * * *